US011944136B2

(12) United States Patent
Parker

(10) Patent No.: US 11,944,136 B2
(45) Date of Patent: Apr. 2, 2024

(54) MULTIFUNCTIONAL MASK

(71) Applicant: Latoya Bradley Parker, Brookhaven, MS (US)

(72) Inventor: Latoya Bradley Parker, Brookhaven, MS (US)

( * ) Notice: Subject to any disclaimer, the term of this patent is extended or adjusted under 35 U.S.C. 154(b) by 709 days.

(21) Appl. No.: 17/098,373

(22) Filed: Nov. 14, 2020

(65) Prior Publication Data

US 2022/0047010 A1 Feb. 17, 2022

Related U.S. Application Data

(60) Provisional application No. 63/066,465, filed on Aug. 17, 2020.

(51) Int. Cl.
*A41D 13/11* (2006.01)
*A41D 13/00* (2006.01)

(52) U.S. Cl.
CPC ..... *A41D 13/1107* (2013.01); *A41D 13/0012* (2013.01); *A41D 13/1161* (2013.01)

(58) Field of Classification Search
CPC ... A41D 13/11–1192; A62B 7/10; A62B 9/06; A62B 18/088; A62B 23/00–025
See application file for complete search history.

(56) References Cited

U.S. PATENT DOCUMENTS 6,823,868 B1 11/2004 Begum
7,044,127 B1 5/2006 DeCastro
2003/0005934 A1 1/2003 Japuntich
2006/0212996 A1* 9/2006 McGrath ..... A41D 13/1161 2/207
2007/0106356 A1* 5/2007 Carstens ..... A41D 13/005 607/114
2015/0059771 A1* 3/2015 Duffy ..... A41D 13/1161 29/896.62
2017/0360121 A1* 12/2017 Hamilton ..... F21V 17/10
2021/0315293 A1* 10/2021 Castillo ..... A41D 13/1169
2021/0337892 A1* 11/2021 Kern ..... A41D 13/1161
2022/0008762 A1* 1/2022 Rubin ..... H05F 1/00
(Continued)

OTHER PUBLICATIONS

Google Search—"patent mask with hole", Jul. 31, 2020 p. 1-3, from p. 1, tile: "face mask that allows you to drink" Star-Telegram.com.
(Continued)

*Primary Examiner* — Rachel T Sippel
(74) *Attorney, Agent, or Firm* — William C West

(57) ABSTRACT

A multifunctional mask having a base covering that covers a wearer's oral and nasal areas, the mask having one or more of the following: one or more pockets located on the base covering for light cargo items; a drape covering the base providing additional protection; a drape extension attached to the drape capable of extending down from the base; an opening area having an opening sized for devices to be inserted in the wearer's mouth; a primary cover covering the opening area; a secondary cover overlapped by the primary cover covering the opening area; a base filter pocket and/or a drape filter pocket for filter materials; attachment slots for attaching the mask to other facial coverings; one or more headset holders for communication devices; and the base having a grid structure allowing air to flow easily through the base to an attached facial covering.

13 Claims, 34 Drawing Sheets

(56) References Cited

U.S. PATENT DOCUMENTS

| | | | | |
|---|---|---|---|---|
| 2022/0015491 | A1* | 1/2022 | Stevens | A42B 3/28 |
| 2023/0043520 | A1* | 2/2023 | Newkirk | G09F 21/02 |
| 2023/0181946 | A1* | 6/2023 | Kalaitzis | A62B 18/025 128/206.19 |

OTHER PUBLICATIONS

Google Search—"patent mask with hole", Jul. 31, 2020 p. 1-3, from p. 1, tile: "face mask that allows you to drink" Star-Telegram.com from p. 2, title: overlapping Musican Mask & Aerosol from Unitedsound.org.

* cited by examiner

MULTIFUNCTIONAL MASK

RELATED APPLICATIONS

This application claims priority to Provisional Application No. 63/066,465 filed Aug. 17, 2020 that is incorporated in the current application.

FEDERAL SPONSORED RESEARCH

None

FIELD OF THE INVENTION

A multifunctional mask having a base covering that covers a wearer's oral and nasal areas, providing protection to a wearer's respiratory system and having additional capabilities when equipped with one or more of the following: one or more pockets located on the base covering for light cargo items; a drape covering the base providing additional protection; a drape extension attached to the drape; an opening area having an opening sized for devices to be inserted in the wearer's mouth; a primary cover covering the opening area; a secondary cover overlapped by the primary cover; a base filter pocket and/or a drape filter pocket for filter materials; attachment slots for attaching the mask to other facial coverings; one or more headset holders for holding communication devices; and the base covering having a grid structure allowing air to flow easily through the base covering to an attached facial covering.

BACKGROUND OF THE INVENTION

Respirator or face masks are widely used to provide some protection to a wearer's respiratory system from dangerous particles in the air. These prior art masks are designed to provide varying levels protection against the transmission of contagious diseases and to protect the respiratory system from toxic substances or allergens in the surrounding atmosphere.

Several prior art masks have been proposed that allow for some level of protection for an individual placing a device, such as a straw, through an opening of the opening area of the mask and into the wearer's mouth without removing the prior art masks. Sealing around the device has been mostly limited to using two panels in the opening area, one over the other, with the device inserted below an edge of the outer panel and then over a second panel edge into the wearer's mouth. The base provides protection by having one or more layers of filter material extended from one side of the base to the other side that covers then nasal and oral areas but providing access through the opening area. Some contagious diseases or other toxic substance may enter the wearer's mouth from around devices that are not sealed off by an opening's perimeter walls.

Prior art mask do not provide for carrying cargo items, such as a credit cards, a driver's license, blue tooth devices, ear buds, pens, or pencils. Additionally, prior art masks do not provide for a base filter pocket and a drape filter pocket sized for filter material that will afford added protection to the wearer. Further, prior art masks do not provide for a headset holder for holding a earbud or a bluetooth device. Still further, prior art masks do not include attachment slots that allow the prior art masks to be worn over an other facial covering.

It is an object of this document to disclose a mask that overcomes the aforesaid deficiencies in the prior art.

It is another object of this document to provide a mask that need not be removed when the wearer wishes to place a device in the wearer's mouth.

It is yet another object of this document to provide a mask that provides one or more drapes that cover any device inserted in the user's or wearer's mouth making it less likely that contaminants will enter the user's mouth.

It is still yet another object of this document to disclose a mask that allows the user to carry light items such as a driver's license or a credit card, pen, or a pencil on the mask.

It is a further object of this document to disclose a mask with attachment slots that allow the mask to be worn over other facial coverings using the other facial covering's straps or ear loops to hold the mask in position.

It is a still further object of this mask to provide a mask that allows the user to place additional filter materials in the mask.

It is a yet further object of this document to disclose a mask that affords the opportunity to carry headsets such as ear buds to the mask.

SUMMARY OF THE INVENTION

The multifunctional mask, hereafter called mask, has a base covering that provides some level of protection to a wearer against harmful particles attempting to enter the nasal area and mouth of the wearer. The base covering, hereafter referred to as base, may take on a variety of forms as will be shown in the many various versions of the base. The base has a base first surface that is the front of the base facing outward when the mask is worn by the user (i.e., wearer) and a base second surface adjacent to a wearer's face. The mask may have one or more pockets that is/are sized to hold cargo such as a driver's license, a credit card, a pen, or a pencil. The mask may further have one or more of the following: a base filter pocket allowing filter material that may be mission specific; an opening area with an opening sized for a device to be inserted in a wearer's mouth; one or more drapes sized to drape over the base; one or more drape cargo pockets for carrying cargo items; a drape filter pocket for more filter material; a drape extension sized like the drape that attaches to the drape may extend downward or fold up over the base providing additional protection; a headset holder disposed and sized to hold headsets such as ear buds or bluetooth devices; and attachment slots, hear after called slots, that allow the mask to be attached to and be worn over other facial covering with the other facial covering's ear loops or straps passed through the slots holding the mask and the other facial covering to the wearer's face.

A version of the mask may be comprised of the base with the pockets and ear loops and the drape. The pockets will be located on each side of the wear's nose and mouth so as not to inhibit the flow of air into and out of the nose and the mouth. The base may further comprise the base filter pocket with the base having a base first part and a base second part with the base filter pocket formed there between. The drape may drape over the device when the device when the device is inserted in the wearer's mouth. The drape may also have the one side edge extended and the other side edge extended, the drape one side edge and drape measuring more than a height of the base as measured from a base top edge to a base bottom edge. The drape may be attached to the base so as to cover the base first surface from a base top edge to the base bottom edge allowing the drape to provide some additional level of protection. The drape with the one side edge and the other side edge extended may be folded over the base to provide yet another layer of protection. The drape may further include one or more drape cargo pockets positioned on either side of the user's nose with the pockets substantially the same as the pockets of the base. The drape may have a drape filter pocket disposed between the drape first surface and the drape second surface with the capability to insert filter material along a drape top edge.

An other version of the mask may comprise an other base and an other drape. The other base may be the base with no base filter pocket and having an opening area with an opening disposed and size to insert a device in the wearer's mouth. The opening area may further have an upper cover (i.e., primary cover) covering the opening, or the opening area may have the upper cover and a lower cover (i.e., secondary cover) covering the opening. The opening is exposed when the device is inserted under an upper cover bottom edge and pushing the upper cover bottom edge upward. The other version of the drape covers the opening area and may cover a portion of the device extended beyond the opening. The other version of the drape may have the drape filter pocket of the drape but may not have the drape cargo pockets. The upper cover and the lower cover may be made of stretch material that allows the opening to be opened and closed as the user inserts and withdraws, respectively, the device, such as a musical instrument or a straw, in and out of the wearer's mouth without removing the mask. The other version of the drape may cover the opening and drape over the instrument providing additional protection from contaminants attempting to enter the opening. The other version of the drape may be located to expose the opening area when the drape bottom edge is lifted upward and then cover portions of the instrument extending outward from the opening. The other version of the drape may have the drape filter pocket.

Yet another version of the mask may comprise the other mask and additionally have the drape extension sized to attach to the other drape and extend downward providing additional protection over the device inserted in the user's mouth. The drape extension is the drape with no drape cargo pockets.

Still yet an other version of the mask may have the other version of the base and the drape extension but with another version of the drape filter pocket with a drape pocket flap. The drape filter pocket is disposed between a drape first side surface of a drape first part and the drape second side surface of a drape second part with the filter material inserted by lifting the drape pocket flap that overlaps the drape first side surface as compared to the version of the drape filter pocket where the filter material is inserted along a drape top edge into the drape filter pocket.

A further version of the mask may be comprised of a further version of the base that is the base with the attachment slots and the headset holders. The ear loops may have one or more of the headset holders disposed and sized to hold headsets such as ear buds or bluetooth devices allowing the user to transmit and/or receive signals. The ear loops may be removable attached to the base using a two part fasteners. The attachment slots, hereafter called slots, allow base to be attached to and worn over another facial covering with the other facial covering's ear loops or straps passed through the slots and used to hold the masks on the other facial covering and to the wearer's face A still further version of the mask may comprise a still further version of the base having the base filter pocket, the opening area, and attachment slots, detachable ear loops with communication holders. The still further masks has a further version of the on drape with drape cargo pockets and the other version of drape filter pocket with the pocket flap.

BRIEF DESCRIPTION OF THE DRAWINGS

Referring to the drawings, where like reference characters are used to indicate corresponding structure through the several views.

DETAILED DESCRIPTION OF THE INVENTION

Figure 1:
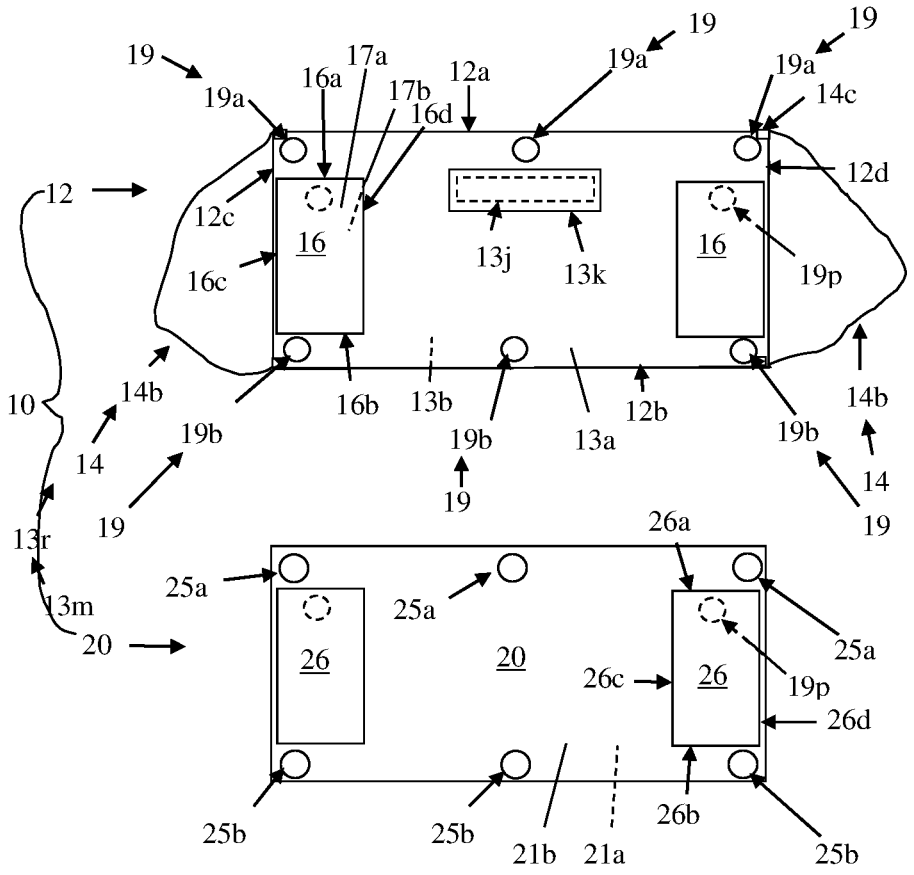
FIG. 1 is a front view of a mask having a detachable drape.
Figure 2:
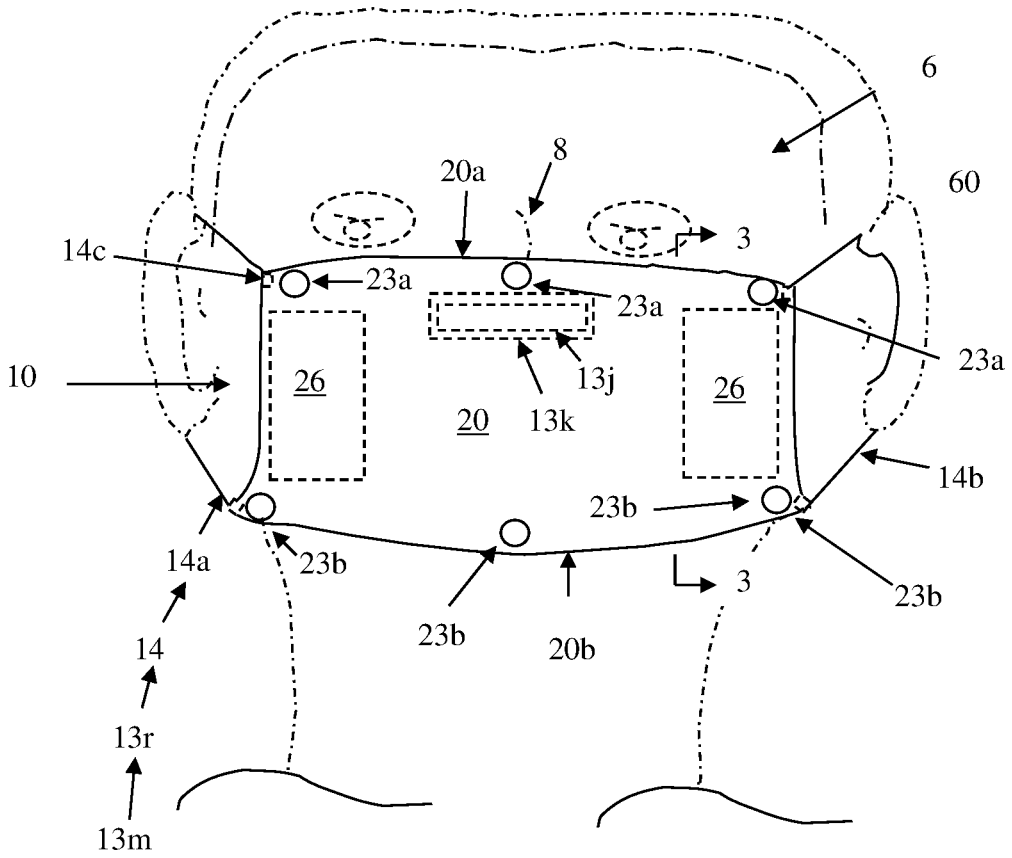
FIG. 2 is a front view of the mask of FIG. 1 with the drape folded upward.

Referring to FIGS. 1 and 2, a version of a multifunctional mask, hereafter called mask 10 is shown. Multifunctional is defined as capable of providing numerous functions, such as: carrying cargo items, providing protection from harmful particles attempting to enter the nasal area and mouth of a wearer, holding headsets, and covering devices entering a wearer's mouth. A version of mask 10 may comprise at least a base covering, also called a base 12, with the base 12 further comprising a base top edge 12*a* (i.e., base first edge), a base bottom edge 12*b* (i.e., base second edge), a base one side edge 12*c*, a base other side edge 12*d*, a base first surface 13*a*, and a base second surface 13*b*. There may be a nose bar 13*j* made of a bendable metal, such as aluminum, covered by a bar panel 13*k* that may be made of cloth, to hold the base 12 on the wearer's nose 8. The base 12 may also have a means for holding the mask 13*m* in position on the wearer's face 6 such as one or more mask retainers 13*r*. The mask retainers 13*r* may be one or more straps attached to one side and the other side of the mask that tie to each other, bands that run from the one side to the other side of the mask, a hood, a fastening belt, or ear loops 14. Referring again to FIG. 1, a first ear loop 14*a* and a second ear loop 14*b* are shown attached to the base 12 using an anchoring means 14*c*. The anchoring means 14*c* may be a weld, an adhesive, a sewn patch, a series of stitches, or two part fasteners that allows the mask retainers 13*r*, such as the ear loops 14, to be removed from the mask 10, or other suitable means for attachment. The first ear loop 14*a* and the second ear loop 14*b* may also be an extension (not shown) of the base first surface 13*a* and the base second surface 13*b* with portions of the base beyond the base one side edge 12*c* and the base other side edge 12*d* removed to form flat loops that can be placed around the wearer's ears. The base 12 may further comprise one or more pockets 16, also called cargo retainers, for carrying cargo items, with the pockets having a pocket top edge 16*a*, also use as the pocket opening edge, a pocket bottom edge 16*b*, a pocket one side edge 16*c*, a pocket other side edge 16*d*, a pocket first surface 17*a*, and a pocket second surface 17*b*, the pocket second surface 17*b* facing the base first surface 13*a*. The cargo items may be a credit card, a state driver license, a pen, or a pencil, and the cargo items may be inserted between the pocket top edge 16*a* and the base first surface 13*a*. The pockets 16 may be spaced 2 centimeters or more from a wearer's nose 8 toward the base one side edge 12*c* and base other side edge 12*d*. The pockets 16 may be permanently attached with a permanent attachment means such as using stitches, rivets, or welds, or attached with two-part fasteners, such as hook and loops fasteners, allowing the pocket 16 to be removed. The pockets may be attached to the base first surface 13*a* along the pocket bottom edge 16*b*, the pocket one side edge 16*c*, and the pocket other side edge 16*d*. Although the pockets 16 are shown as rectangular with the pocket top edge 16*a* running horizontal with a center of the pocket top edge 16*a* located at 12 o'clock and a center of the pocket bottom edge 16*c* at 6 o'clock, the pocket 16 may have any other orientations on a clock cycle and other shapes. For example, the center of the pocket top edge 16*a* may be at 3 o'clock with the center of the pocket bottom edge 16*c* at 9 o'clock. Also, the pocket one side edge 16*c*, the pocket bottom edge 16*b*, and the pocket other side edge 16*d* taken together form a pocket non-opening edge. The pocket non-opening edge may be u-shaped as shown, an arc (not shown) other geometric shapes. The base 12 may also comprise one or more fasteners 19. The fasteners 19 may use a suffix "a" to identify the upper or top orientation (i.e., along the base first edge), the suffix "b" to identify the bottom or lower orientation (i.e., along the base second edge), and the suffix "p" for a pocket fastener. For example, the base 12 may have a one or more base top fasteners 19*a* and base bottom fasteners 19*b* when the mask 10 is disposed on the face of the wearer. The pocket 16 may have one or more pocket fasteners 19*p* located along the pocket top edge 16*a*. Additionally, the mask 10 may comprise a drape 20 that can drape or cover a device, such as a musical instrument, when the wearer of the mask inserts the device under the base bottom edge 12*b* of the base 12 into the wearer's mouth.

Figure 3:
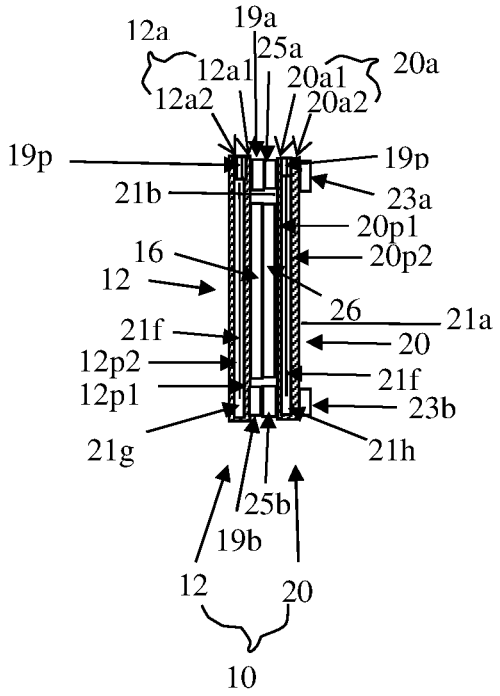
FIG. 3 shows a front view of FIG. 2 with the drape folded down.
Figure 4:
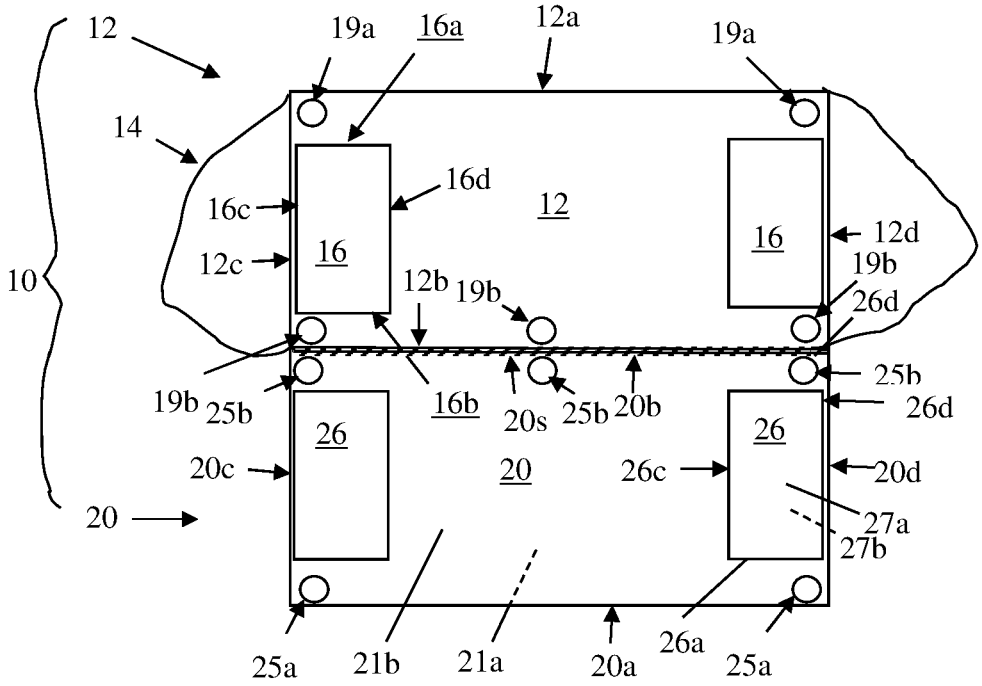
FIG. 4 shows a side view of the mask of FIG. 3.

Referring to FIGS. 1, 2-3, the mask 10 may further comprise a drape 20 covering the base 12 and providing another layer of protection. FIG. 1 shows that the drape 20 may be attached to the base bottom fasteners 19*b* with coordinating drape first surface top fasteners 23*a*. Referring to FIG. 2, the drape 20 may also be flipped and attached to the base top fasteners 19*a* using drape second surface top fasteners 25*a* or attached along the base top edge 12*a* also called base first edge. The drape 20 may be sized to substantially cover the base 12 and may be disposed attached to the base 12 and able to fold up over the base 12 as shown in FIG. 3. The drape may be attached to the base top fasteners 19*a* and the base bottom fasteners 19*b* as shown in FIG. 3 or attached to the base bottom edge 12*b* as shown in FIG. 4. Referring again to FIG. 4 with the drape folded down, the drape 20 comprises a drape top edge 20*a* (i.e., a drape first edge), a drape bottom edge 20*b* (i.e., a drape second edge), a drape one side edge 20*c*, a drape other side edge 20*d*, a drape first surface 21*a*, a drape second surface 21*b*. The drape 20 may further comprise one or more drape first surface top fasteners 23*a* and one or more drape first surface bottom fasteners 23*b*, one or more drape second surface top fasteners 25*a* and one or more drape second surface bottom fasteners 25*b* allowing the drape 20 to be fastened to the one or more base top fastener 19*a* and base bottom fasteners 19*b* as shown in FIG. 3. The drape 20 may further comprise one or more drape cargo pockets 26, the drape cargo pockets 26 having a drape cargo pocket top edge 26*a*, a drape cargo pocket bottom edge 26*b*, a drape cargo pocket one side edge 26*c*, a drape cargo pocket other side edge 26*d*, a drape cargo pocket first surface 27*a* and a drape cargo pocket second surface 27*b* with cargo items inserted between the drape cargo pocket second surface 27*b* and the base 12 along the drape cargo pocket top edge 26*a*. Referring again to FIGS. 2 and 3 the base 12 may further comprising a base filter pocket 21*g*; the base 12 having a base first part 12*p*1 and a base second part 12*p*2 with the base filter pocket 21*g* formed there between. The base first part 12*p*1 may have a base top edge first part 12*a*1 and the base second part 12*p*2 may have a base top edge second part 12*a*2, the base top edge first part 12*a*1 and the base top edge second part 12*a*2 forming the base top edge 12*a* and allowing filter material 21*f* to be inserted there between into the base filter pocket 21*g*. The base top edge second part 12*a*2 and the base top edge first part 12*a*1 may be mated together using a pocket fastener 19*p* holding the filter material 21*f* in the base filter pocket 21*g*. The drape 20 may further comprising a drape filter pocket 21*h*; the drape 20 having a drape first part 20*p*1 and drape second part 20*p*2 with the drape filter pocket 21*h* formed there between. The drape first part 20*p*1 may have a drape top edge first part 20*a*1 and the drape second part 20*p*2 may have a drape top edge second part 20*a*2, the drape top edge first part 20*a*1 and the drape top edge second part 20*a*2 forming the drape top edge 20*a* and allowing the filter material 12*f* to be inserted there between into the base filter pocket 21*g*. The drape top edge second part 20*a*2 and the drape top edge first part 20*a*1 may be mated together using a pocket fastener 19*p* holding the filter material 21*f* in the drape filter pocket 21*h*. Referring to FIG. 4, the drape 20 may also be attached to the base 12 using a permanent attachment means 20*s* such as stitches, a weld, an adhesive, or rivets, or any acceptable permanent fastening means. As will be discussed later the drape bottom edge 20*b* may not be permanently attached to the base bottom edge 12*b* but the drape top edge 20*a* may also be aligned with the base top edge 12*a* and attached along the base top edge 12*a* using the permanent attachment means 20*s*. This will allow the drape bottom edge 20*b* to only flip upward.

Figure 5:
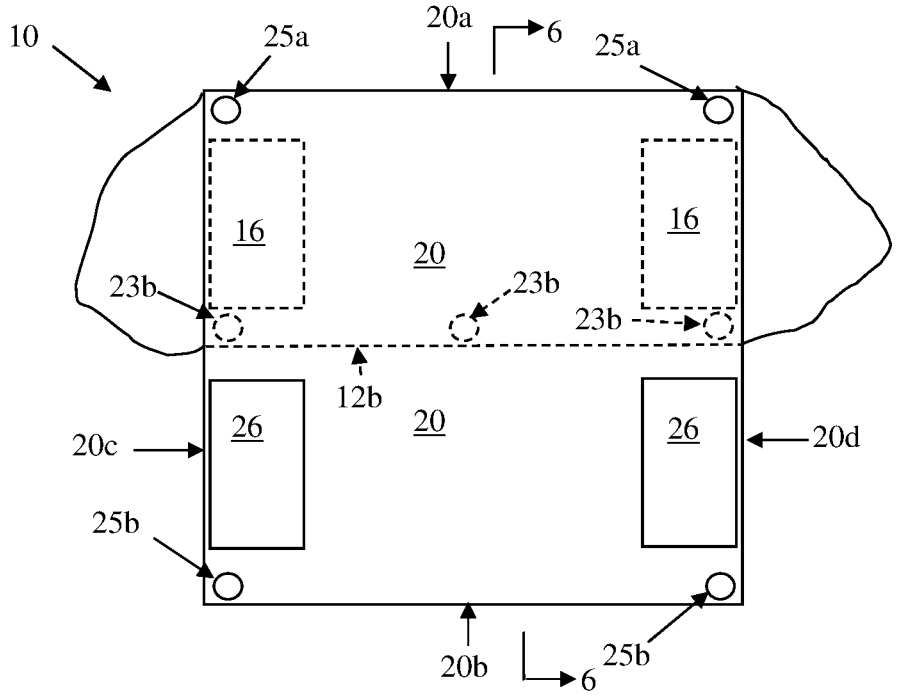
FIG. 5 shows a front view of the mask with the drape extended.
Figure 6:
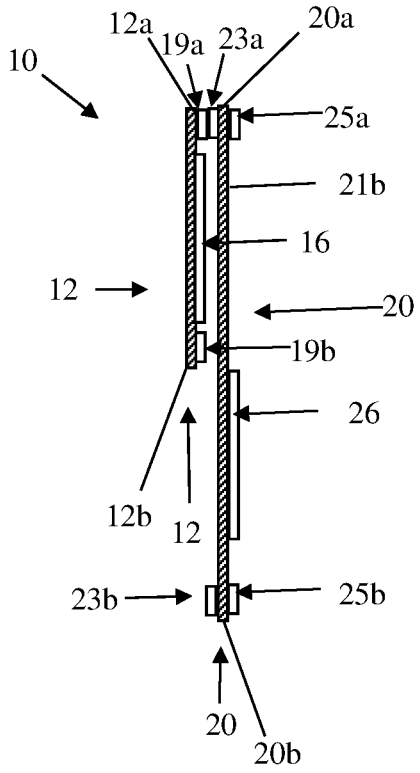
FIG. 6 shows a sectional view along line 6-6 of FIG. 5.
Figure 7:
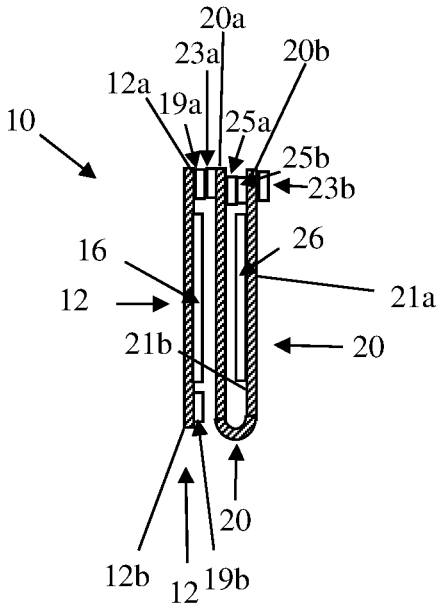
FIG. 7 shows the sectional view of FIG. 6 with the drape folded back onto itself.

Referring to FIG. 5 and FIG. 6, a cross sectional view along line 6-6 of FIG. 5, a drape 20 is shown that is substantially twice the height of the base 12 as measured form the base top edge 12*a* to the base bottom edge 12*b* as shown in FIG. 6. The drape may have one or more drape first surface top fasteners 23*a*, one or more drape first surface bottom fasteners 23*b*, one or more drape second surface top fasteners 25*a* and the one or more drape second surface bottom fasteners 25*b* of FIG. 3. The drape first surface top fasteners 23*a* may be located on the drape first surface 21*a* below the drape top edge 20*a* and one or more of the drape first surface bottom fasteners 23*b* may be located above the drape bottom edge 20*b*, while the drape second surface bottom fasteners 25*b* may be located on the drape second surface 21*b* above the drape bottom edge 20*b* and the drape second surface top fasteners 25*a* located below the drape top edge 20*a*. Referring to FIG. 6, the drape first surface top fastener 23*a* may be disposed sized to mount to the base top fastener 19*a* and although not shown, the drape first surface top fastener 23*a* may also be disposed to mount also to the base bottom fastener 19*b*. When the drape first surface top fastener 23*a* is disposed to mount to the base bottom fastener 19*b*, the drape 20 extends substantially below the base 12. When the one or more drape first surface top fasteners 23*a* is mounted to the one or more base top fasteners 19*a* and the drape bottom edge 20*b* is aligned with the base bottom edge 12*b*, the drape 20 forms a second layer of protection from particles entering the user's mouth and nose. Additionally, looking to FIG. 7, the drape bottom edge 20*b* may be folded back onto the drape top edge 20*a* with the base top edge 12*a* also aligned with the drape bottom edge 20*b* to form three layers of protection. The one or more drape second surface bottom fasteners 25*b* may be disposed to fasten to the drape second surface top fasteners 25*a* and the drape first surface top fasteners 23*a* may be disposed to fasten to the base top fasteners 19*a*.

Figure 8:
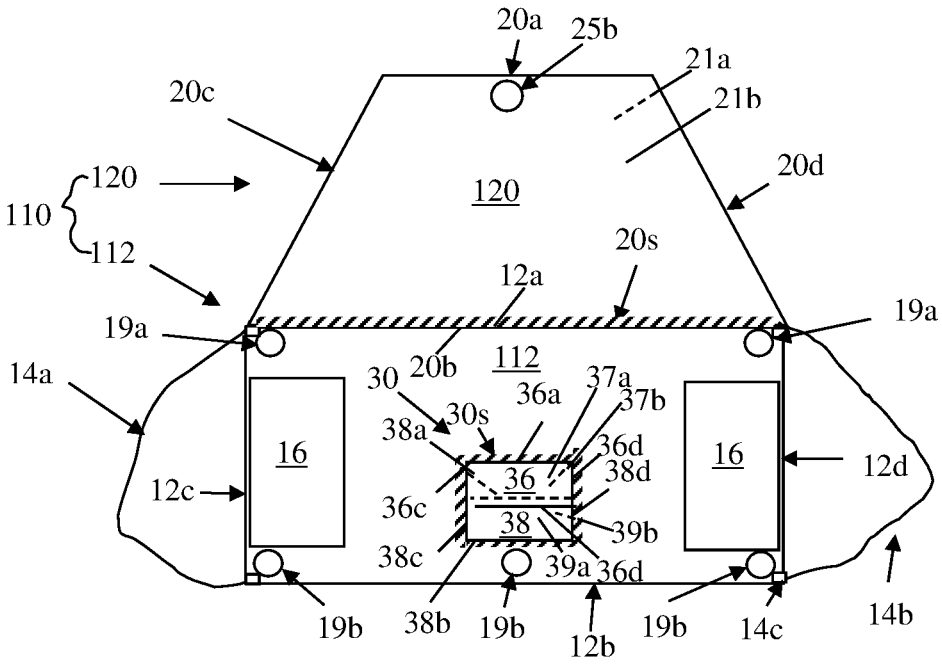
FIG. 8 shows an other version of the mask.
Figure 9:
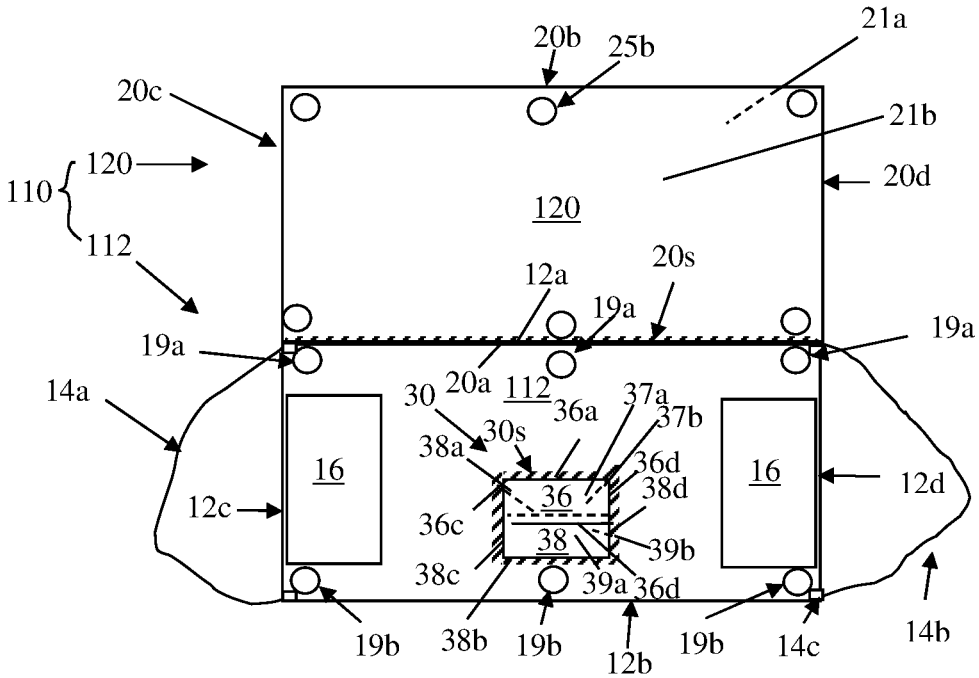
FIG. 9 shows the other version of the mask of FIG. 8 with the drape folded upward exposing an opening area.
Figure 10:
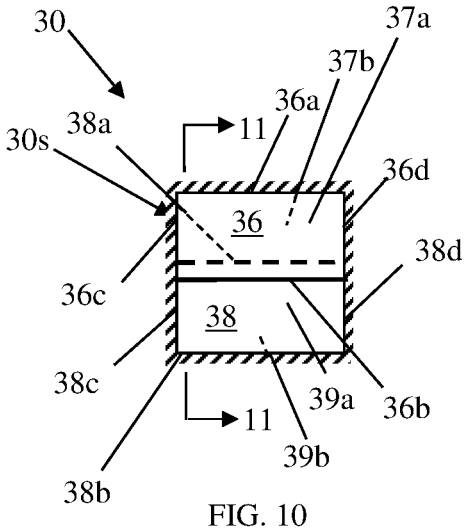
FIG. 10 shows an enlarged view of the opening area of FIG. 9.

Referring to FIGS. 8-10, an other mask 110 is presented having an other base 112 and an other drape 120 that is an other version of the drape 20 without drape cargo pockets 26. The other drape 120 forms a flap covering an other base 112, the other base 112 being an other version of the base 12 of FIG. 1 further comprising an opening area 30. It is understood that all versions of the drape 20 can be attached to the any version of the base 12. FIG. 8 shows the other drape 120 that is trapezoidal shaped forming a flap while FIG. 9 shows the rectangular shaped other drape 120. The other drape 120 may also be rectangular, trapezoidal or other geometric shapes (not shown). Looking to FIG. 9-12, the drape 20 can be lifted to provide a device access to the wearer's mouth through an opening 30*a* of the opening area 30 of the other base 112. The drape 20 may be fastened to the other base 112 with the permanent attachment means 20*s* along the base top edge 12*a* and the drape top edge 20*a*. The opening area 30 is disposed and sized for the insertion of the device such as musical instruments into the wearer's mouth. The opening area 30 may comprise an upper or primary cover 36 having an upper cover top edge 36*a* and an upper cover bottom edge 36*b*, an upper cover one side edge 36*c* and an upper cover other side edge 36*d*. The upper cover 36 has an upper cover first surface 37*a* and an upper cover second surface 37*b* with the upper cover second surface 37*b* overlapping a lower or secondary cover 38 of the opening area 30*a*. The upper cover top edge 36*a*, the upper cover one side edge 36*c* and an upper cover other side edge 36*d* may be attached to the other base 12 using stitches 30*s*, an adhesive or molded as part of the other base 112. The lower cover 38 has a lower cover top edge 38*a*, a lower cover bottom edge 38*b*, a lower cover one side edge 38*c*, and a lower cover other side edge 38*d*. The lower or secondary cover 38 further comprises a lower cover first surface 39*a* and a lower cover second surface 39*b*. The lower cover one side edge 38*c*, the lower cover other side edge 38*d*, and the lower cover bottom edge 38*b* may be attached to the other base 112 in a manner similar to the upper or primary cover 36 with the upper cover bottom edge 36*b* overlapping the lower cover first surface 39*a*.

Figure 11:
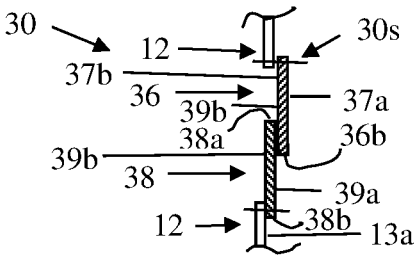
FIG. 11 shows sectional view along line 11-11 of FIG. 10.
Figure 12:
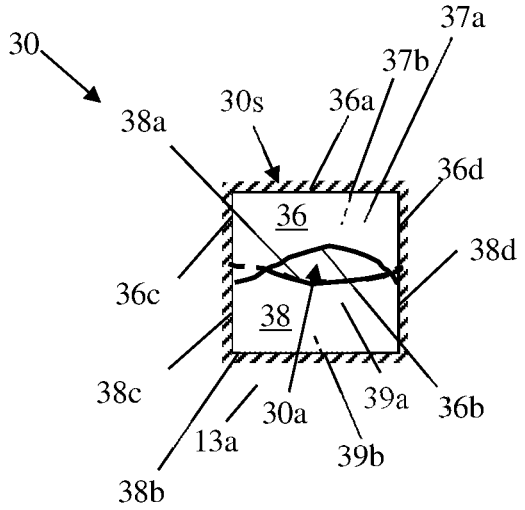
FIG. 12 shows an opening in the opening area of FIG. 9.
Figure 13:
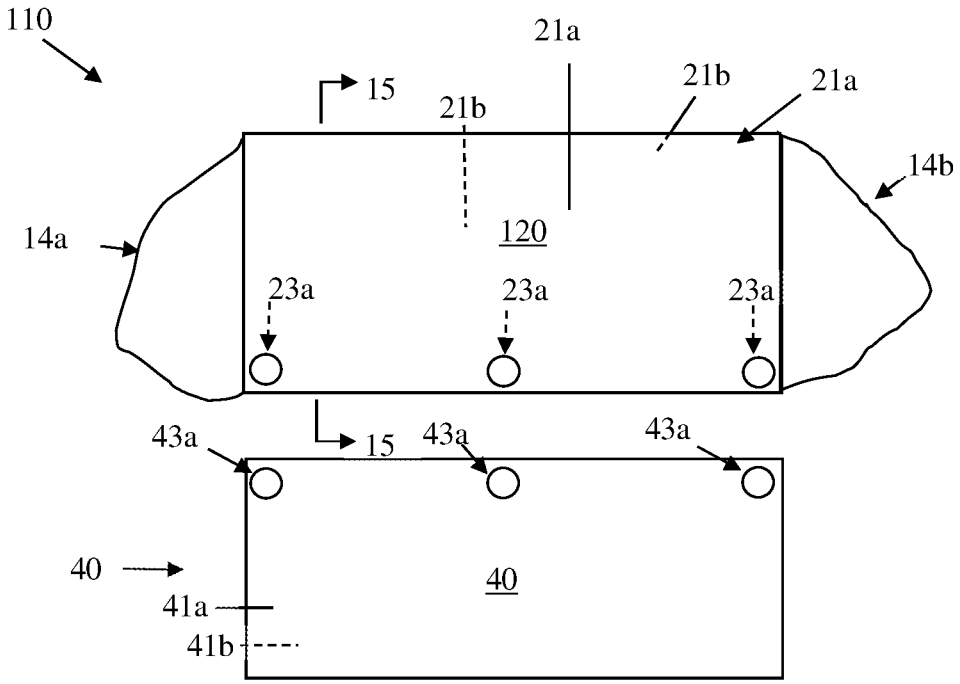
FIG. 13 shows yet an other version of the mask.
Figure 14:
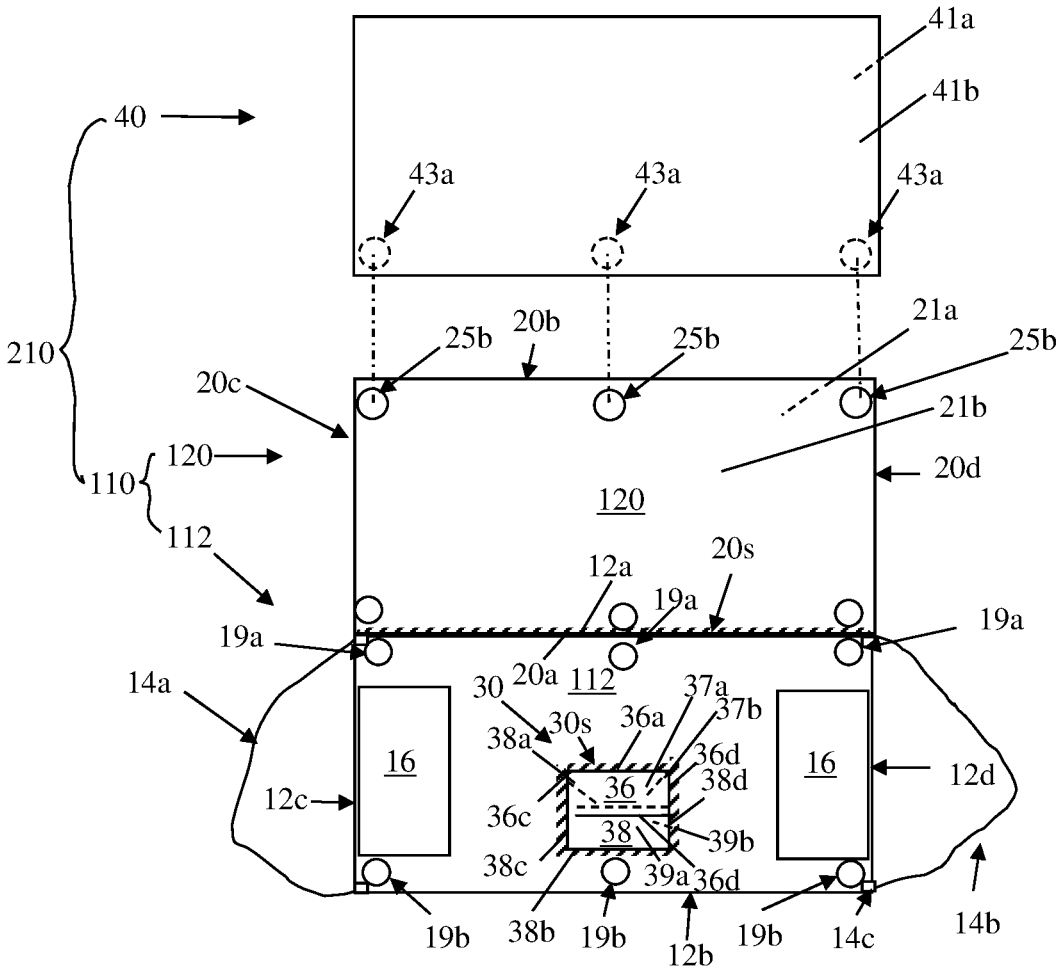
FIG. 14 shows the yet other version of mask with the other version of the cover raised
Figure 15:
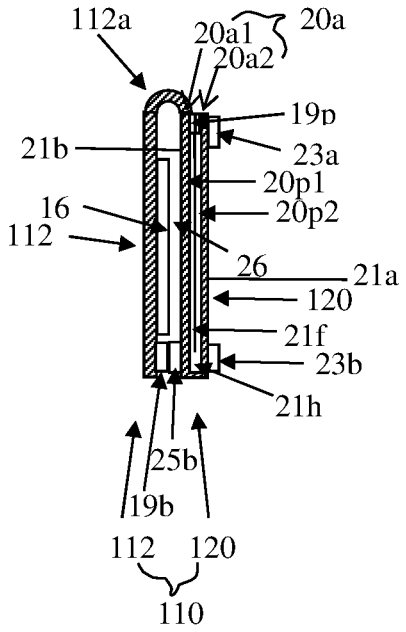
FIG. 15 shows a section along line 15-15 of FIG. 13.

Referring to FIG. 10, an enlarged view of the opening area of FIG. 9 is shown and FIG. 11 shows a cross-sectional view along line 11-11 of the opening area 30 of FIG. 10. Looking to FIGS. 11 and 12 and the device may be inserted between the lower cover first surface 39*a* and the upper cover bottom edge 36*b* raising the upper cover bottom edge 36*b* above the lower cover top edge 38*a* creating the opening 30*a* to insert the device over the lower cover top edge 38*a* into the wearer's mouth positioned behind the opening 30*a*. The upper or primary cover 36 and the lower or secondary cover 38 may be made of knit fabrics produced by a production method called looping or they may be made partially of elastic fibers such as elastane or spandex allowing the fabric to stretch and wrap around the device when the device is inserted into the wearer's mouth, and then return to their initial state and close the opening 30*a* when the device is withdrawn from the opening 30*a*. Also, and not shown, the upper cover bottom edge 36*b* and the lower cover top edge 38*a* each may fold back over a stretchable cord of material (not shown) onto the upper cover first surface 37*a* and to the lower cover second surface 39*b*, respectively, wrapping around the stretchable cord providing an elastic upper cover bottom edge 36*b* and lower cover top edge 38*a*, respectively. Also not shown, the upper cover bottom edge 36*b* may extend 1-6 mm below where the lower cover bottom edge 38*b* is attached to the other base 112 in FIGS. 11 and 12, allowing the lower or secondary cover 38 to be omitted and the device to be inserted between the upper cover bottom edge 36*b* and the base first surface 13*a* and into the wearer's mouth.

Referring to FIGS. 13-16, yet another version of the mask, a yet another mask 210, is presented being the other version of the mask 110 plus a drape extension 40 added to the other mask 110. The other drape 120 of the other mask 110 may provide for additional filtering using one or more layers of filter material 21*f*, each adjacent to any other, inserted in the drape filter pocket 21*h* of the other drape 120. The drape extension 40 may have an extension first surface 41*a*, and extension second surface 41*b*, and one or more extension first surface top fasteners 43*a*. The drape extension 40 is like the other 120 and the drape 20 for FIG. 3 but may not have drape cargo pockets 26. Referring again to FIGS. 13 and 14, the one or more extension first surface top fasteners 43*a* may be attached to one or more the drape second surface bottom fasteners 25*b* on the drape second surface 21*b*, thereby providing additional protection for a musician by covering more of the instrument inserted through the opening area 30. Referring again to FIG. 15, the other base 112 may have a curved portion 112*a* when the other base 112 is attached to the other drape 120.

Figure 16:
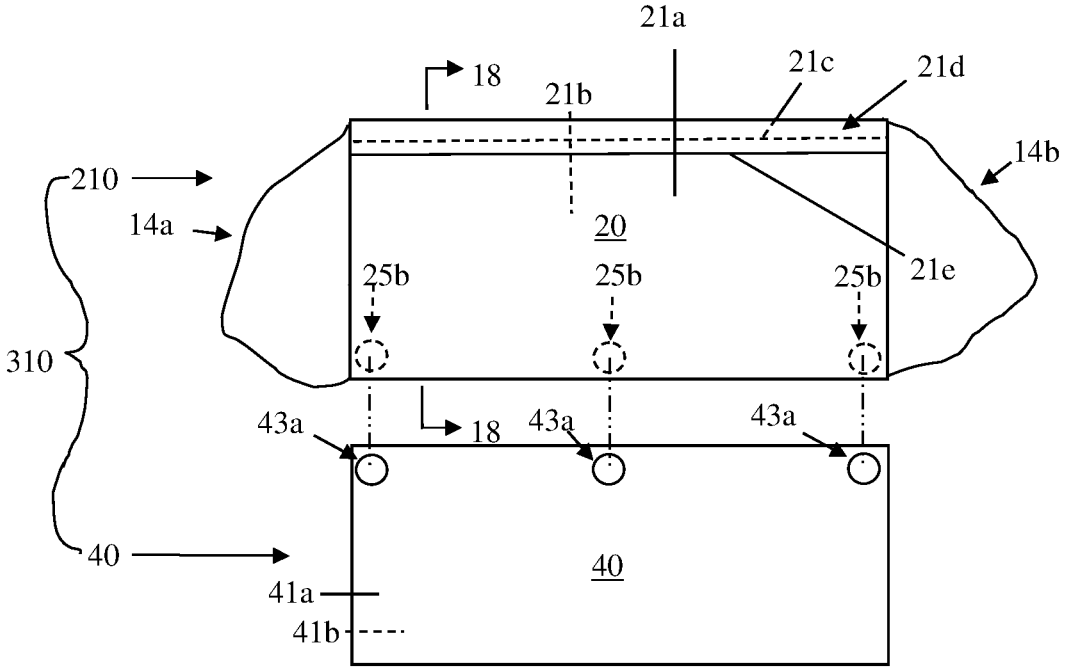
FIG. 16 shows a still yet another version of the mask.
Figure 17:
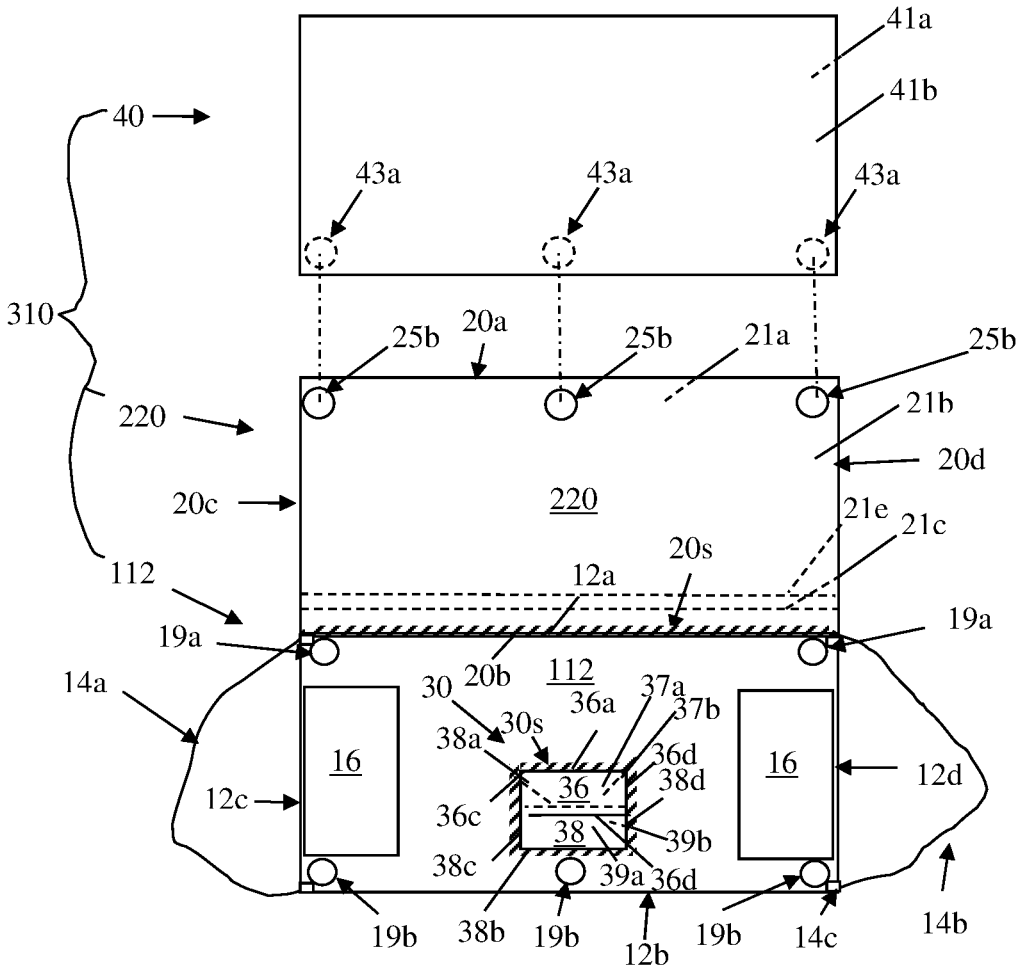
FIG. 17 shows the yet another version of the mask with the other version of the cover raised.
Figure 18:
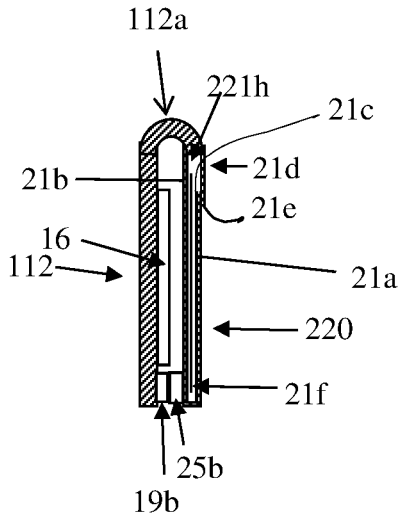
FIG. 18 shows a section view along line 18-18 in FIG. 16.

Referring to FIGS. 16-18, a still yet another version of the mask, a still yet another mask 310, having the drape extension 40, the other base 112, and yet another version of the drape, a yet other drape 220, with an other version of the drape filter pocket, an other drape filter pocket 221*h*, that may provide for additional filtering using one or more layers of the filter material 21*f*, each adjacent to any other forming a filter, inserted in an other drape filter pocket 221*h* of the yet another drape 220. Looking to FIGS. 16-18, the yet another drape 220 has the drape first surface 21*a* that may have a drape first surface top edge 21*c* overlapped by a drape pocket flap 21*d* having a flap edge 21*e*, allowing the filter material 21*f* to be inserted between the flap edge 21*e* and the drape first surface 21*a* into other drape filter pocket 221*h*. The still yet another mask 310 may further comprise the drape extension 40 having the extension first surface 41*a*, and the extension second surface 41*b*, and one or more of the extension first surface top fasteners 43*a*. Again, the drape extension 40 may be the drape 20 of FIG. 1 with no the drape cargo pockets 26 but may have the drape filter pocket 21*h*. The one or more extension first surface top fasteners 43*a* may be attached to one or more the drape second surface bottom fasteners 25*b* on the drape second surface 21*b*, thereby providing additional protection for a musician by covering more of the instrument inserted through the opening area 30.

Figure 19:
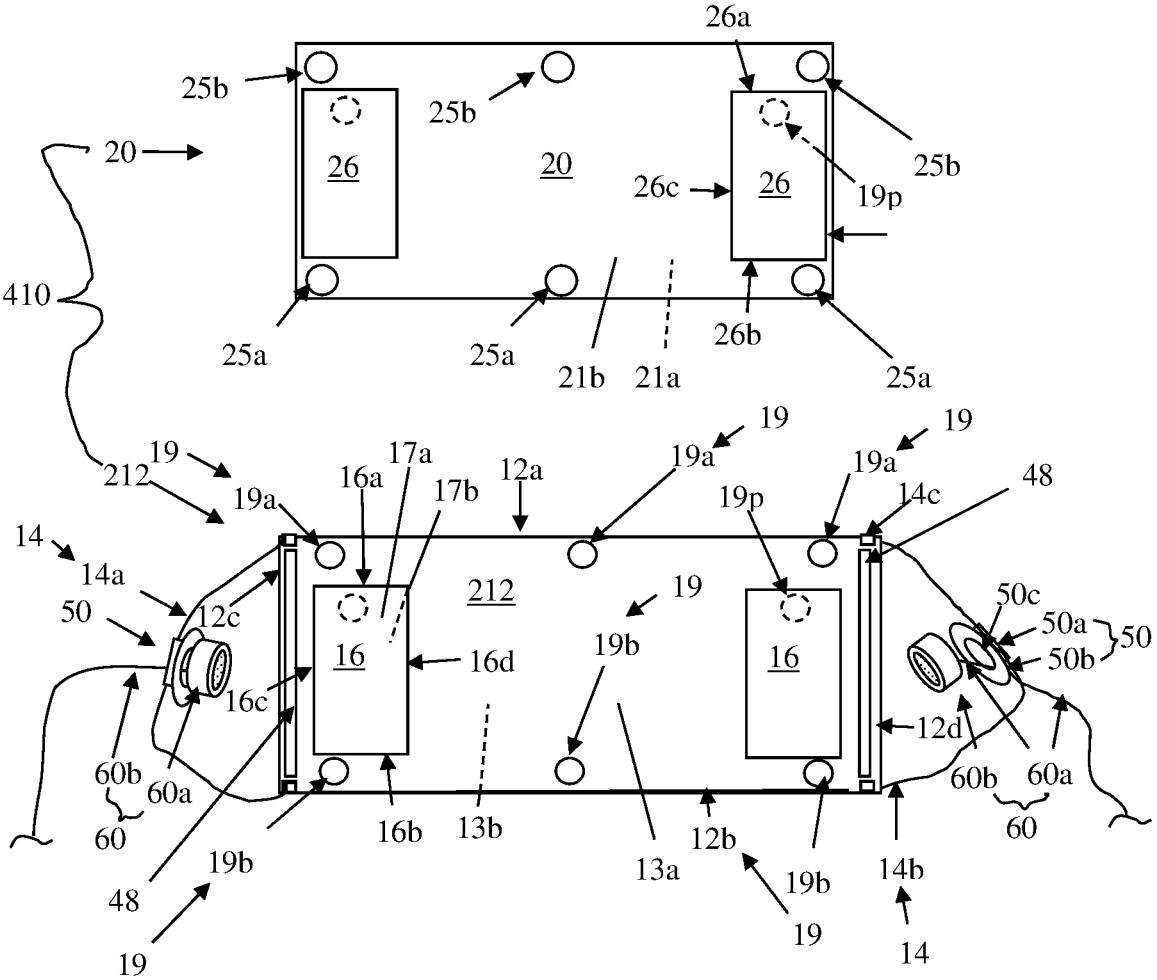
FIG. 19 shows a further version of the mask having a further version of the base with attachment slots and ear loops with headset holders.
Figure 20:
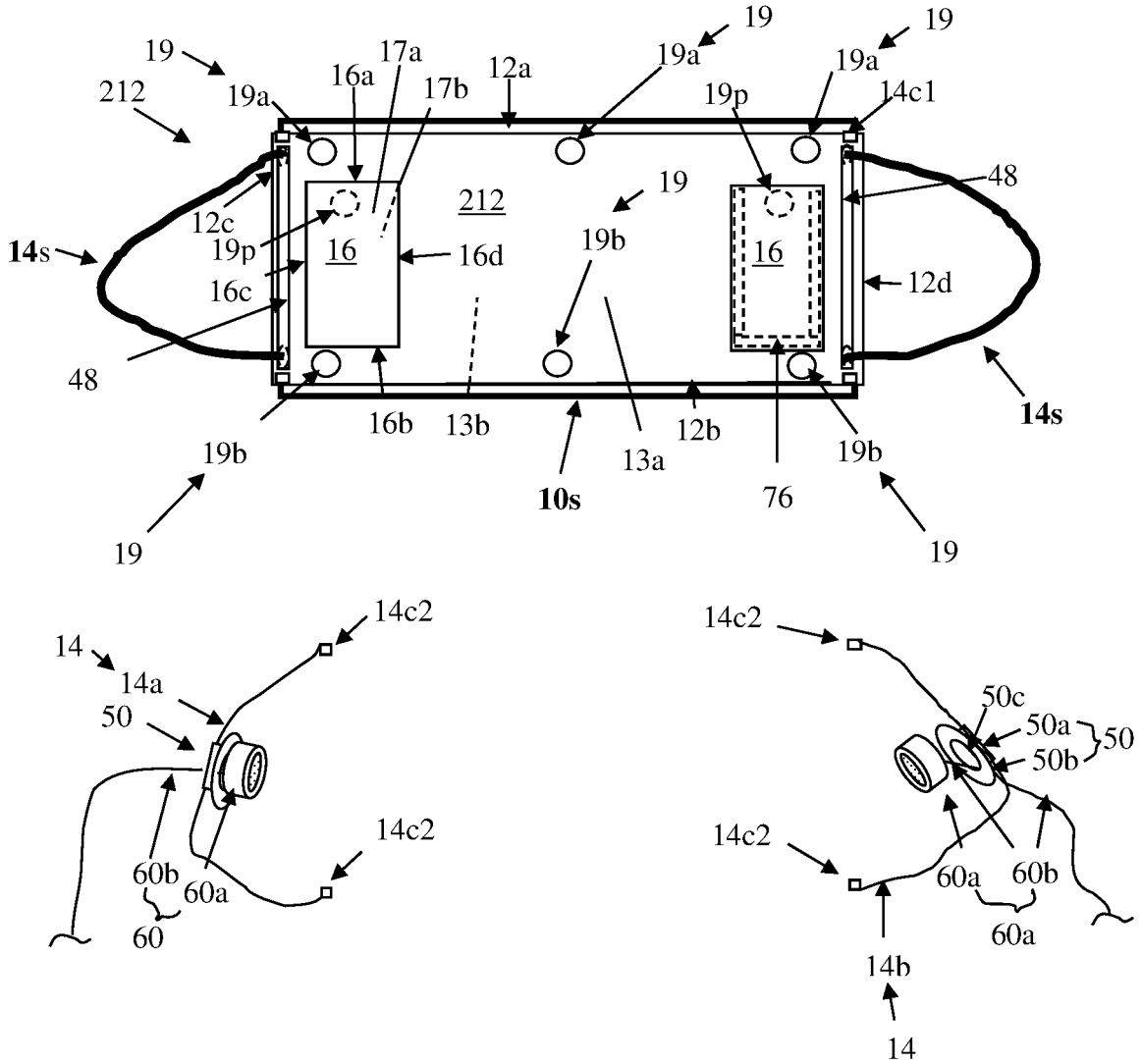
FIG. 20 shows the further version of the base attached over another facial covering.
Figure 21:
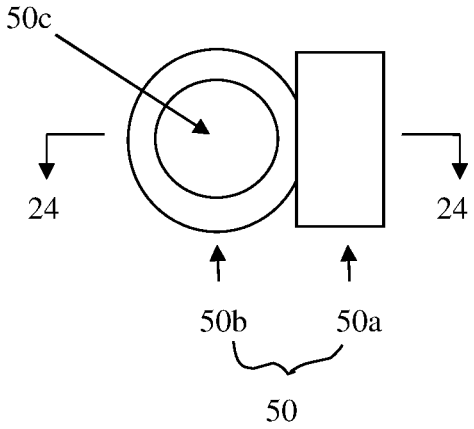
FIG. 21 shows a headset holder.
Figure 22:
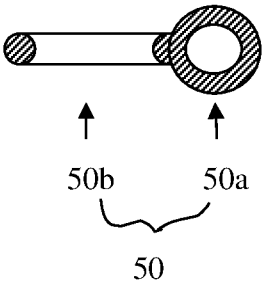
FIG. 22 shows a sectional along line 22-22 of FIG. 21.

Referring to FIGS. 19 and 20, a further version of the mask, a further mask 410 is shown. The further mask 410 comprises a the drape 20 and a further version of the base, a further base 212 The further base 212 is a further version of the base 12 of FIG. 1 with attachment slots 48. The attachment slots 48, also called slots, are an opening running from the base first surface 13*a* to the base second surface 13*b* forming the further base 212 and with the drape 20 forming the further mask 410. The attachment slots 48 may be sized to accept ear loops 14 of other personal protective equipment or facial coverings in the marketplace and the attachment slots 48 be spaced 2-8 mm, preferably 4 mm, from the base top edge 12*a*, the base bottom edge 12*b*, the base one side edge 12*c*, and the base other side edge 12*d*. When the attachment slots 48 are elongated as shown in FIG. 19, the attachment slots 48 may be 2-6 mm wide, preferably 5 mm, and the attachment slots 48 spaced 2-8 mm, preferably 4 mm, from the base top edge 12*a* and from the base bottom edge 12*b* with the attachment slot there between. When the attachment slots are other geometric shapes, such as circular (not shown), they may 2-8 mm in diameter, preferably 5 mm Referring to FIG. 20, the attachment slots 48 may be disposed and sized to receive other facial covering ear loops 14*s* of the other facial covering 10*s* when the base 12 is disposed overlaying the other facial covering 10*s*. One of the attachment slots 48 may be disposed between one of the pockets 16 and the base one side edge 12*c* and another of the attachment slots 48 may be disposed between another one of the pockets 16 and the base other side edge 12*d*. The other facial covering ear loops 14*s* of the other facial covering 10*s* are placed through the attachment slots 48 of the base 12 enabling the base 12 and the other facial covering 10*s* to be secured to the wearer's face with the other facial covering ear loops 14*s*. The first ear loop 14*a* and the second ear loop 14*b* originally attaches to the base 12 may be detachable and are shown in FIG. 20.

Referring again to FIG. 19-22, the yet further base 212 may have headset holders 50 disposed on the ear loops 14. The headset holders 50 may comprise a holder tube 50*a* that is hollow attached to a holder ring 50*b* that has an eyelet 50*c*. The holder ring 50*b* may have an eyelet 50*c* centrally located. The holder tube 50*a* and the holder ring 50*b* may be made of stretchable material with each of the ear loops 14 disposed from one end of the holder tube 50*a* to be an other end of the holder tube 50*a*. For example, when inserting an ear bud 60 in the headset holder, the eyelet 50*c* formed by the holder ring 50*b* is stretched to accept the case 60*a* of the ear bud 60 through the eyelet 50*c* with the eyelet 50*c* then closing around the wires 60*b* of the ear bud 60. The eyelet 50*c* may be circular as shown but could be elliptical and have an un-stretched eyelet diameter of 1-10 mm, preferably 6 mm. The holder tube 50*a* may be disposed attached to the ear loop 14 and the ear loop running through the holder tube 50*a*, or the holder tube 50*a* may be allowed to slide along the ear loop 14 providing flexibility in positioning the ear bud 60. The ear loops 14 may be detachable with the anchoring means 14*c* having an anchor first part 14*c*1 remaining in the yet another base 212 and an anchor second part 14*c*2 on the ear loop 14.

Figure 23:
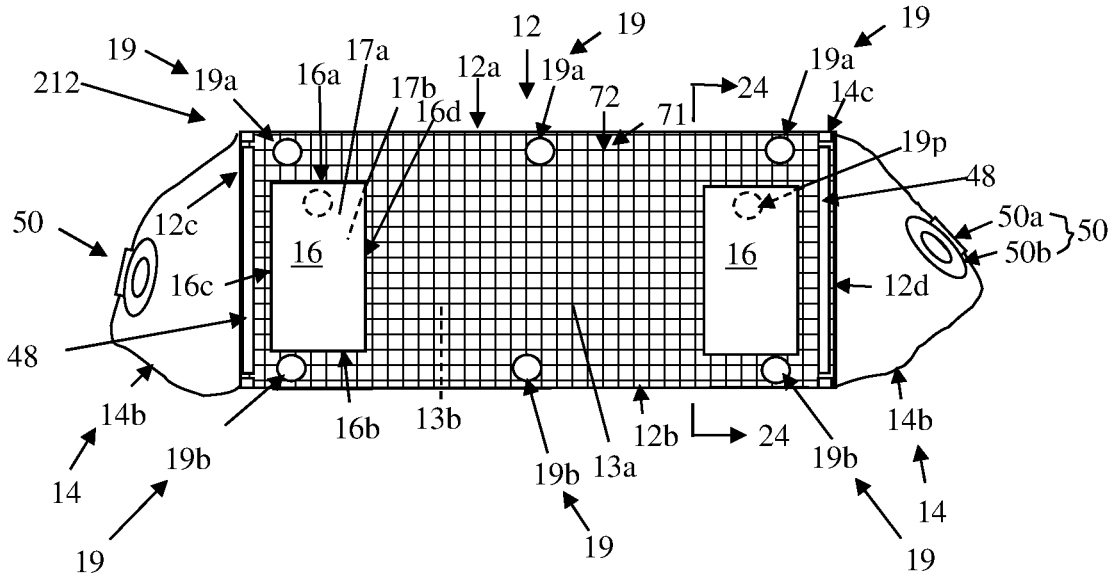
FIG. 23 shows the further version of the base formed in a grid.
Figure 24:
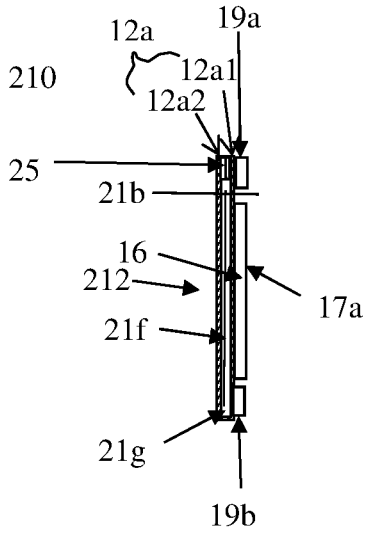
FIG. 24 shows a sectional along line 24-24 of FIG. 23.

Referring to FIGS. 23-24, the yet further base 212 may be made of first cords 71 and second cords 72 forming a mesh or grid structure allowing air to freely pass through the between the first cords 71 and between the second cords 72. The first cords 71 are shown traverse to the second cords 72. The first cords 71 and the second cords 72 may be spaced 1 mm to 10 mm from any other first cord 71 or second cord 72, respectively, although other spacing ranges are possible. The first cords 71 and second cords 72 may be cylindrical although other geometric shapes are possible. The first cords 71 and second cords 72 may have a diameter between 1 nm and 1 mm, although larger and smaller diameters are possible.

Figure 25:
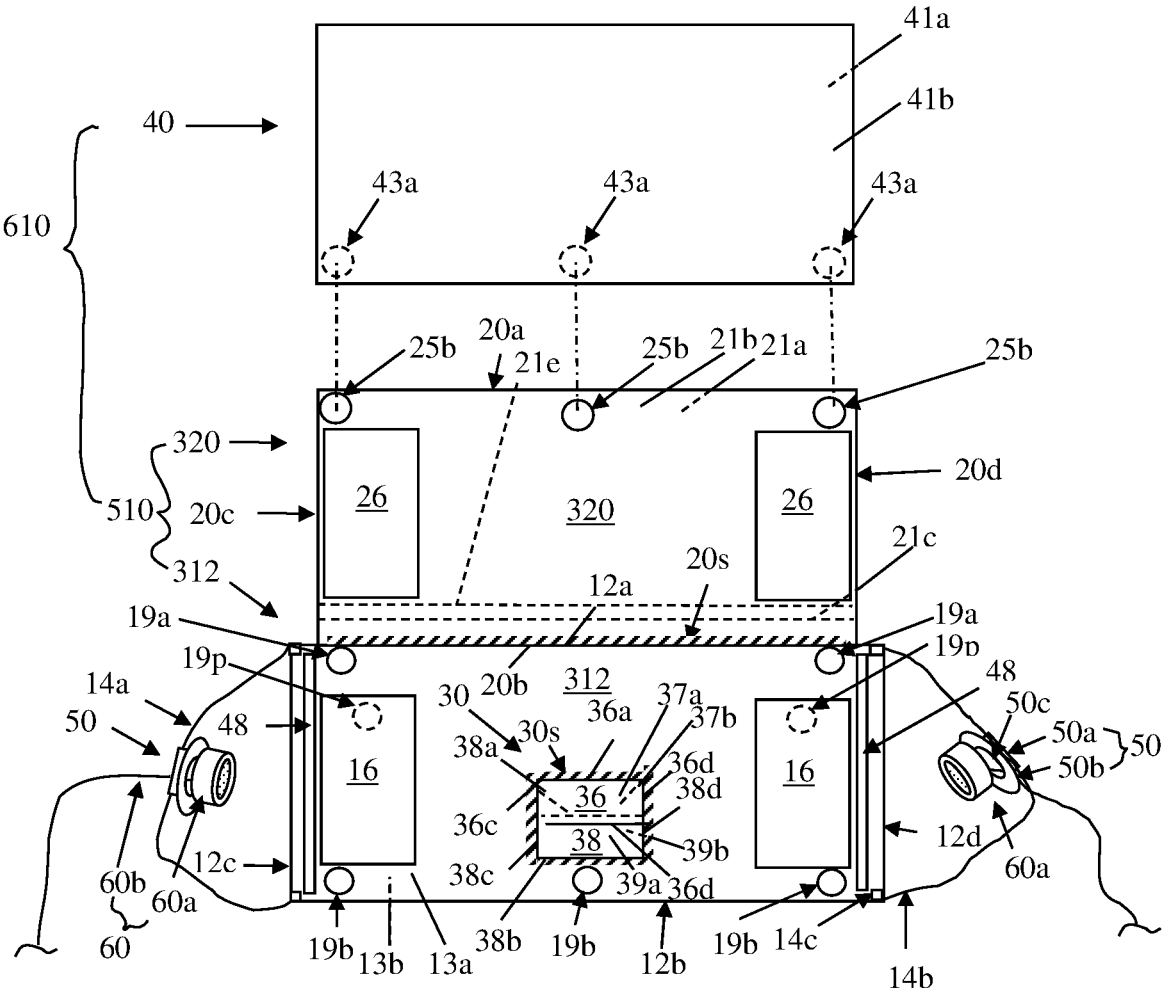
FIG. 25 shows a yet further mask with drape cargo pockets and still further version of the base with attachment slots, headset holders, an opening area, and the other version of the drape filter pocket.
Figure 26:
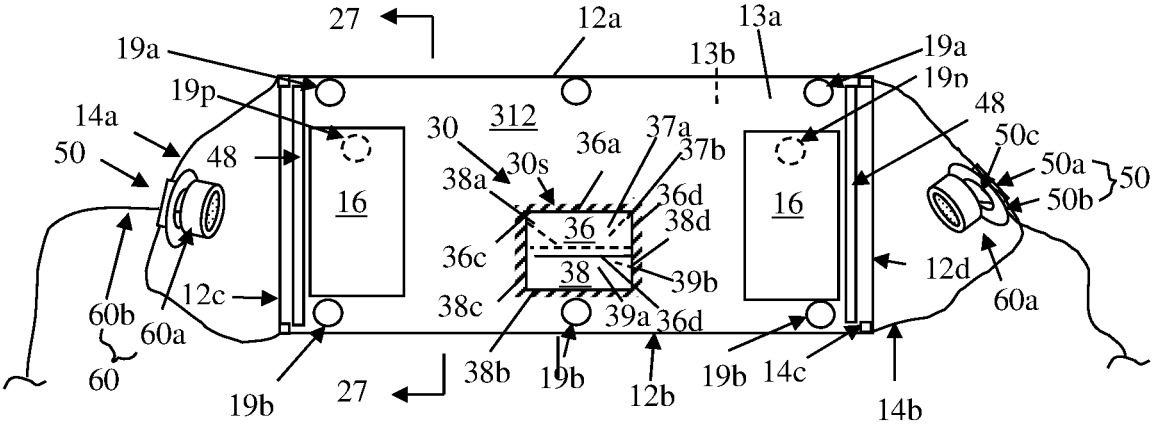
FIG. 26 shows the still further base of FIG. 25.
Figure 27:
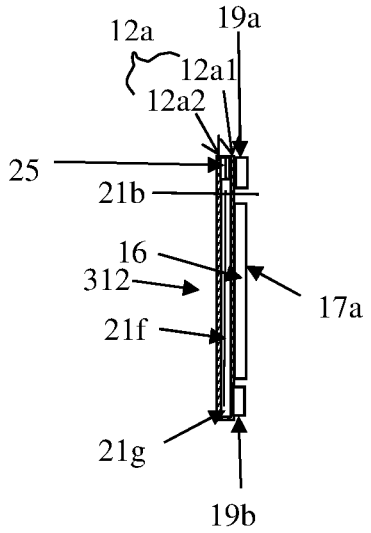
FIG. 27 shows a section along line 26-26 of FIG. 26.

Referring to FIG. 25, a yet further version of the mask, a yet further mask 510 is shown. The yet further mask 510 has a further version of the drape, a further drape 320, with drape cargo pockets 26 and the other drape filter pocket 221*h*, and a yet further version of the base, a yet further base 312, having the base filter pocket 21*g* and the opening area 30, the attachment slots 48, and the headset holders 50 on the ear loops 14 that may be detachable. FIG. 26 is a frontal view of the further base 312 with the attachment slots 48 and the opening area 30. The yet further mask 510 and the drape extension 40 form a still further version mask, a still further mask 610. FIG. 27 is a sectional view of the yet further base 312 along line 27-27 that shows the base filter pocket 21*g*.

The filter material 21*f* in the base pocket may have a filter opening aligned and sized to match the opening area 30 allowing devices such as straws or musical instrument mouth pieces to fit thorough the opening area 30 and the filter material 21*f* and inserted into the wearer's mouth.

Figure 28:
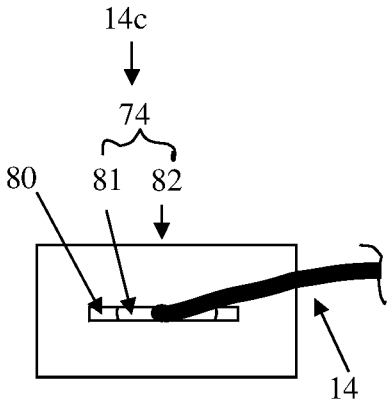
FIG. 28 shows a button and eye-loop fastener.
Figure 29:
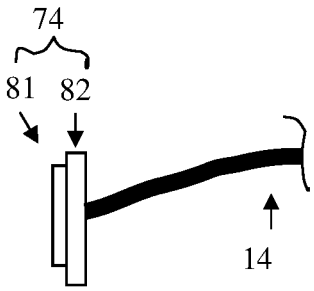
FIG. 29 shows side view of the button and eye-loop fastener of FIG. 28.
Figure 30:
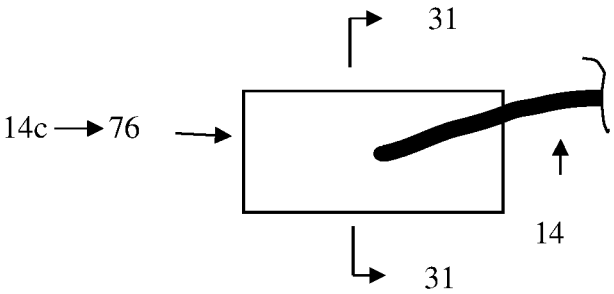
FIG. 30 shows a hook and loop fastener.
Figure 31:
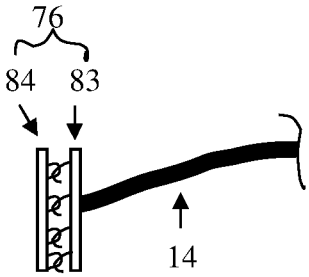
FIG. 31 shows a side view of the hook and loop fastener of FIG. 30.
Figure 32:
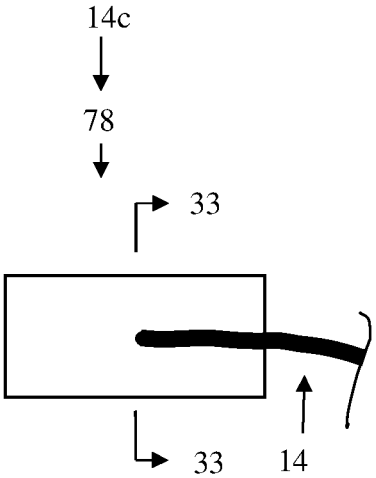
FIG. 32 shows a snap fastener.
Figure 33:
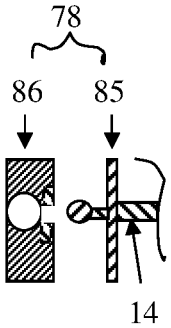
FIG. 33 shows a side view of a snap fastener of FIG. 32.
Figure 34:
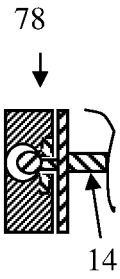
FIG. 34 shows another side view of a snap fastener of FIG. 32.

Referring to FIGS. 28-33, the anchoring means 14*c* of FIG. 19 may be a two part fastener having an anchor first part 14*c*1 and an anchor second part 14*c*2, allowing the ear loops 14 to be removed as shown in FIG. 20. Referring to FIGS. 28-34, the anchoring means 14*c* may be a button and eye-loop fastener 74, a hook and loop fastener 76, a snap fastener 78, or other suitable means for attachment allowing the ear loops 14 to be removed from the base 12 of FIG. 27. Referring to FIGS. 20, 28 and 29, the button and eye-loop fastener 74 may comprise a button 81 that may be the anchor second part 14*c*2, and an eye-loop part 82 that has an eye-loop 80 disposed sized to receive the button 81. The eye-loop part 82 may be the anchor first part 14*c*1 of FIG. 20. Referring to FIGS. 20, 30 and 32, the hook and loop fastener 76 may have a hook part 83 disposed sized to mate to a loop part 84. The hook part 83 may be the anchor second part 14*c*2 on an end of the ear loops 14 with the loop part 84 being the anchor first part 14*c*1 mounted to then yet another base 212. Referring to FIGS. 20 and 32-34, the snap fastener 78 may comprise a ball part 85 and a cavity part 86 with the ball part 85 sized to mate to the cavity part 86. The ball part 85 may be the anchor second part 14*c*2 on an end of the ear loops 14 with the cavity part 86 being the anchor first part 14*c*1 mounted to the base 12.

Figure 35:
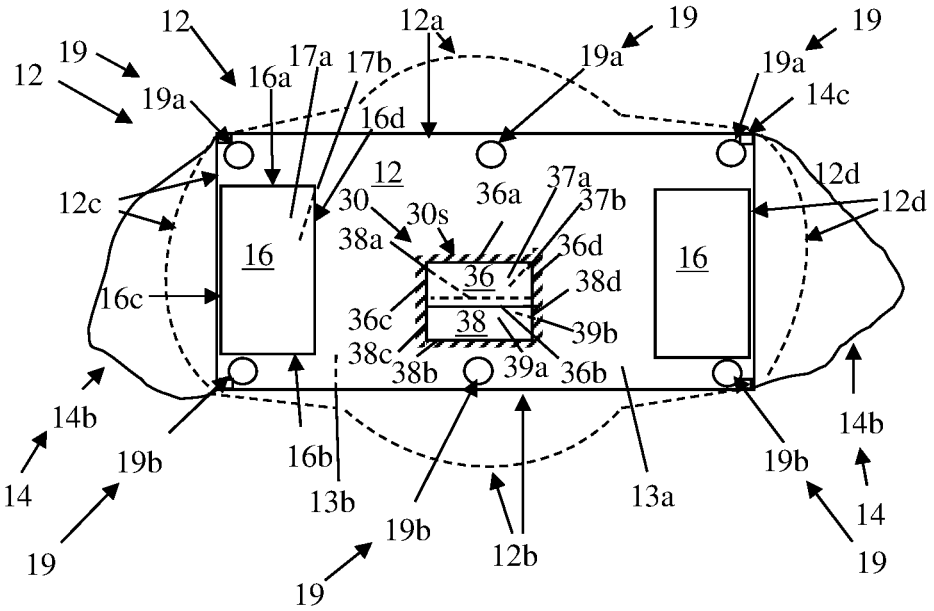
FIG. 35 shows the base of the mask with convex base top, one side, other side, and bottom edges.

Referring to FIG. 35, the base top edge 12*a* and the base one side edge 12*c* may be substantially parallel to the base bottom edge 12*b* and the base other side edge 12*d*, respectively, as shown in FIG. 1 and FIG. 26, but referring again to FIG. 26, they may be convex as referenced to a center of the base 12 as shown by dashed lines for each, allowing the mask 10 to better fit the user's face. Looking to FIG. 27, varying face sizes may also be accommodated by the mask 10, the other mask 110, and the yet another mask 210 and the still yet another mask 310 mask by having one or more folds 46 on the base 12 allowing the base 12 to extend over a wearer's nose and below a wearers chin. A distance from the base top edge 12*a* to the base bottom edge 12*b* narrows from the center of the mask toward the base one side edge 12*c* and the base other side edge 12*d*. As such, the base top edge 12*a* extends from the base bottom edge 12*b* at the center of the base 12 by stretching out the one or more folds 46 as indicated by the dashed lines.

Referring to FIG. 1, the base top edge 12*a* and the base one side edge 12*c* may be substantially parallel to the base bottom edge 12*b* and the base other side edge 12*d*, respectively. Referring again to FIG. 35, the base top edge 12*a*, the base one side edge 12*c*, the base bottom edge 12*b*, and the base other side edge 12*d* they may be convex as referenced to a center of the base 12 as shown by dashed lines for each, allowing the mask 10 to better fit the user's face. Looking to FIG. 36, varying face sizes may also be accommodated by the mask 10, the other mask 110, and the yet another mask 210 and the still yet another mask 310 mask having one or more folds 46 as demonstrated on the base 12 of the mask 10 allowing the base top edge 12*a* and the base bottom edge 12*b* to extend over a wearer's nose and below a wearer's chin, respectively. A distance from the base top edge 12*a* to the base bottom edge 12*b* narrows from the center of the mask toward the base one side edge 12*c* and the base other side edge 12*d*. As such, the base top edge 12*a* extends from the base bottom edge 12*b* at the center of the yet another mask 210 by stretching out one or more folds 46.

Figure 36:
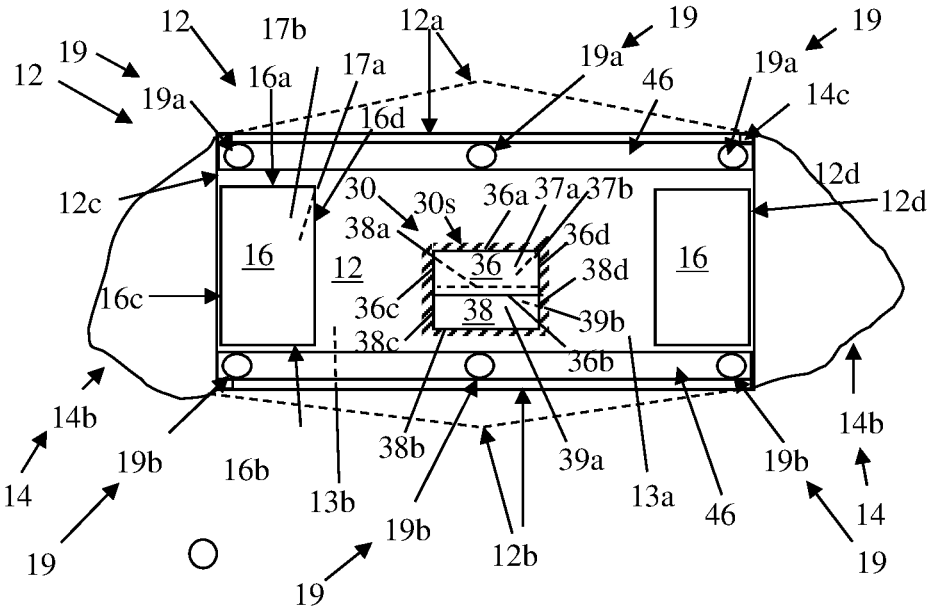
FIG. 36 shows the base of the mask with folds.

Referring to FIG. 36, varying face sizes may also be accommodated the mask 10, the other mask 110, and the yet another mask 210 and the still yet another mask 310 mask having one or more folds 46 as demonstrated on the base 12 of the mask 10 allowing the base top edge 12*a* and the base bottom edge 12*b* to extend over a wearer's nose and below a wearer's chin, respectively. A distance from the base top edge 12*a* to the base bottom edge 12*b* narrows from the center of the mask toward the base one side edge 12*c* and the base other side edge 12*d*. As such, the base top edge 12*a* extends from the base bottom edge 12*b* at the center of the yet another mask 210 by stretching out one or more folds 46.

Figure 37:
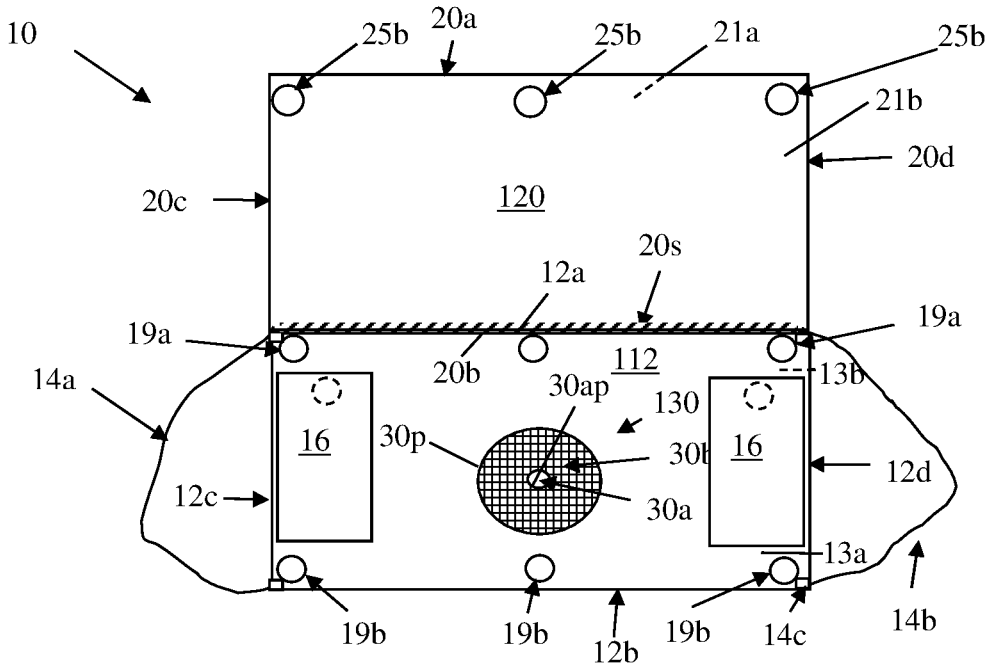
FIG. 37 shows the other version of the mask with another opening area.
Figure 38:
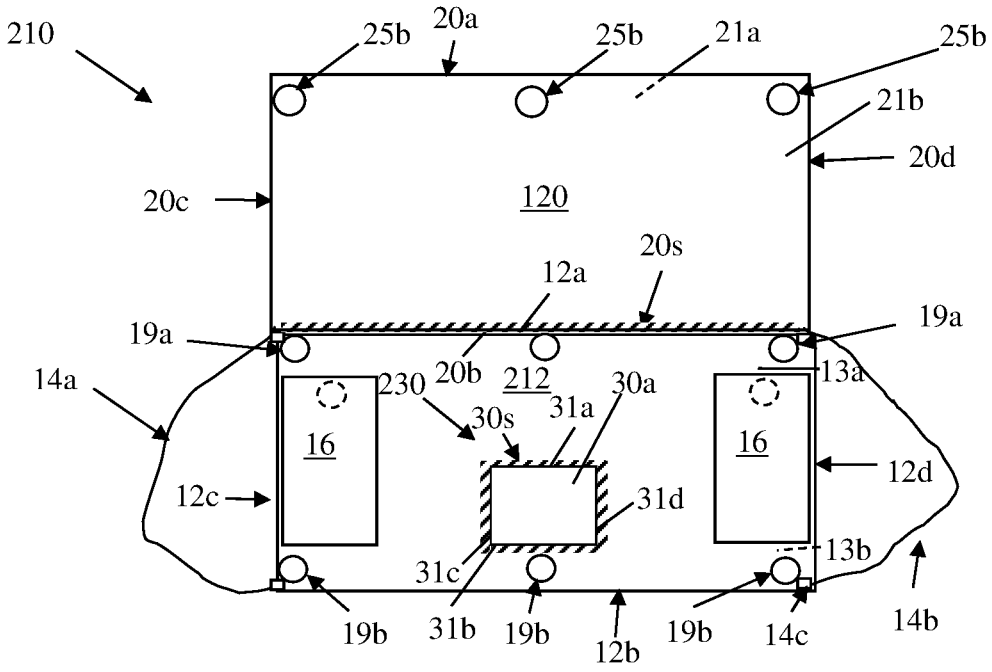
FIG. 38 shows the other version of the mask with yet another version of the opening area.

Referring to FIG. 37, another opening area 130 may have an opening area perimeter 30*p* around an opening panel 30*b* is shown. The opening panel 30*b* is capable of stretching, and the opening panel 30*b* further has an opening perimeter 30*ap* disposed sized to allow the device to fit through the opening panel 30*b* into the wearer's mouth and the opening perimeter 30*ap* then closing around the device. Although the opening panel 30*b* is shown as circular, the panel may be other geometric shapes. Looking to FIG. 38, it is realized that the bases, such as the other base 112 may have yet another opening area 230 with just an opening 30*a* having an opening area top edge 31*a*, an opening area bottom edge 31*b*, an opening area one side edge 31*c*, and an opening area other side edge 31*d*; and without the primary cover 36 or the secondary cover 38 of FIG. 10. Referring to FIG. 38 with the opening panel 30*b* deleted, the opening area perimeter 30*p* is the same as the opening perimeter 30*ap* of FIG. 37.

Figure 39:
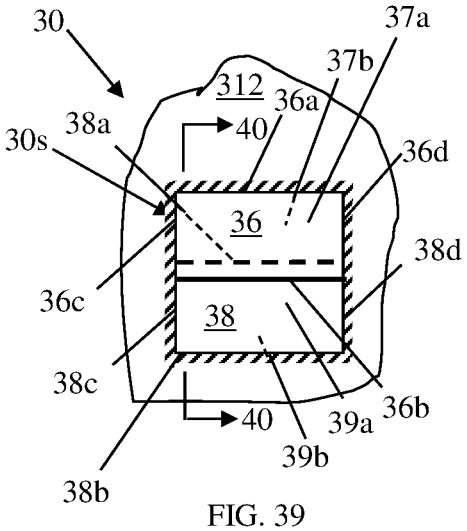
FIG. 39 shows the opening area of the yet further version of the base.
Figure 40:
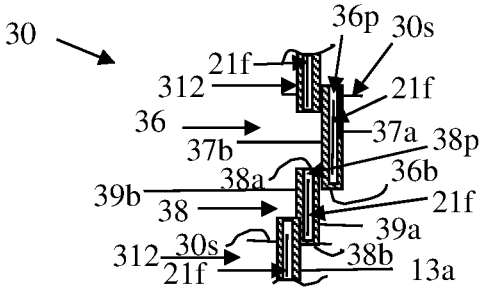
FIG. 40 shows a section along line 40-40 of FIG. 39.

Referring to FIG. 39-40, the opening area 30 may have the primary cover 36 that may have a primary filter pocket 36*p* and the secondary cover 38 that may have a secondary filter pocket 38*p*, each having filter material 21*f*. The filter material 21*f* may be disposed between the upper cover first surface 37*a* and the upper cover second surface 37*b* in the primary filter pocket 36*p*, and the filter material 21*f* may also be placed between the lower cover first surface 39*a* and the lower cover second surface 39*b* in a secondary filter pocket.

Figure 41:
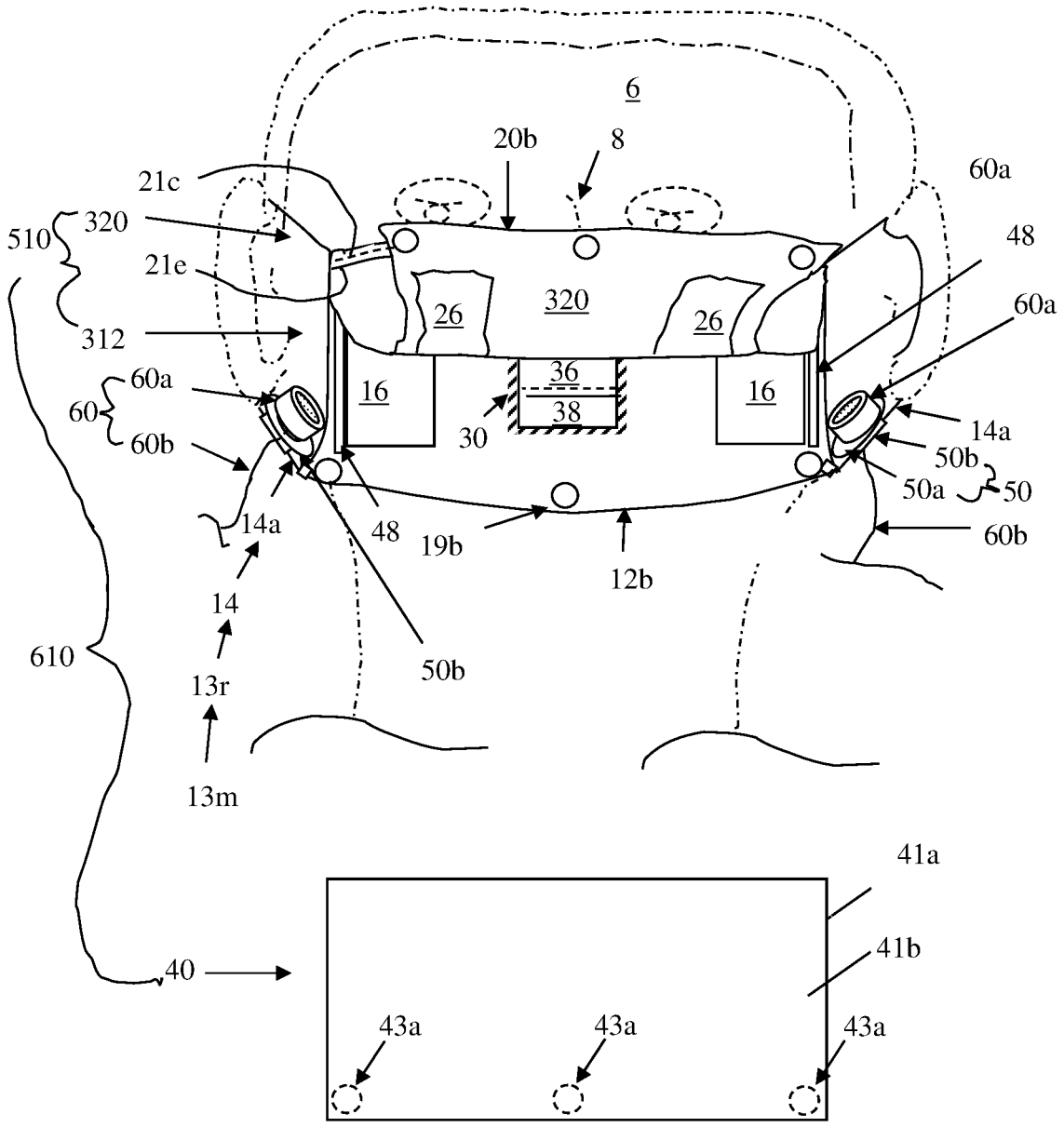
FIG. 41 shows the still further version of the mask of FIG. 25 with the further drape lifted.
Figure 42:
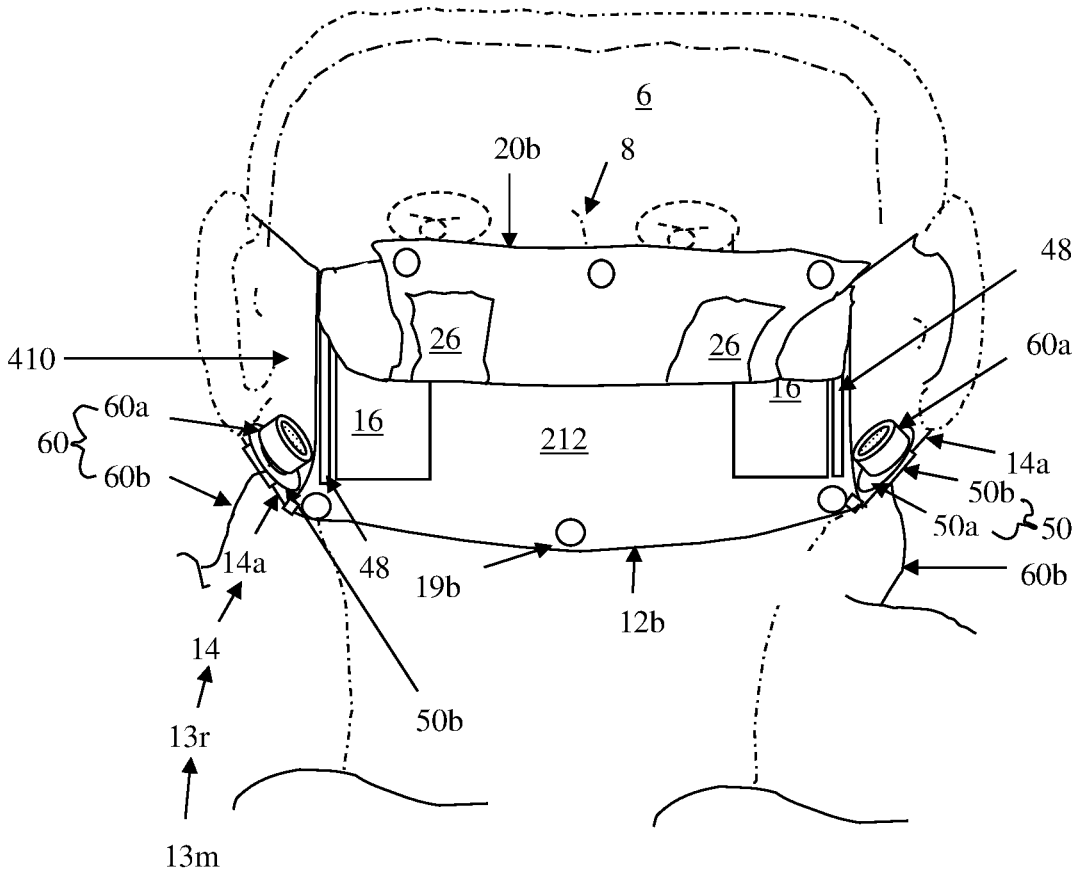
FIG. 42 shows the further version of the mask of FIG. 19 with the drape lifted.

Referring to FIG. 41, the still further mask 610 of FIG. 25 is shown with the drape extension 40 detached and the further drape 320 lifted providing access to the opening area 30. Referring to FIG. 42, the further mask of FIG. 19 is shown with the drape 20 lifted providing access to the opening area 30.

All versions of the mask 10 may be made of a number materials such as: straps or ear loops 14 made out of polyisoprene; areas covering the made of polyurethane; a nose clip made of aluminum; filters from filter material 21*f* that may be polypropylene; and any valves, and valve diaphragm (not shown) made of polypropylene. The base first surface 13*a* may be a different color than the base second surface 13*b* allowing the wearer to easily determine that the base second surface 13*b* should be adjacent to the wearer's face. Filter pockets such as the base filter pocket 21*g* and the drape filter pocket 21*h* preferably may be made of moisture absorbing materials such as cotton, cotton blend, or other moisture absorbing materials, but should not be made of polyester or other non-breathable fabric but with at least one layer of filter material 21*f* that is moisture absorbing covering the base 12. The outer fabric of the bases may be made of polypropylene or non-stretch fabric such as denim, twill, canvas, duck cloth, or other tight woven materials. The ear loops 14 may be made of 1.6 mm or 1/16 inch round cord or 3.175 mm or 1/8 inch braided cord, or 4 mm wide and 1 mm thick flat stretch material, or elastic or ties sewn onto the base 12 and tied in the back of the wearer's head.

Figure 43:
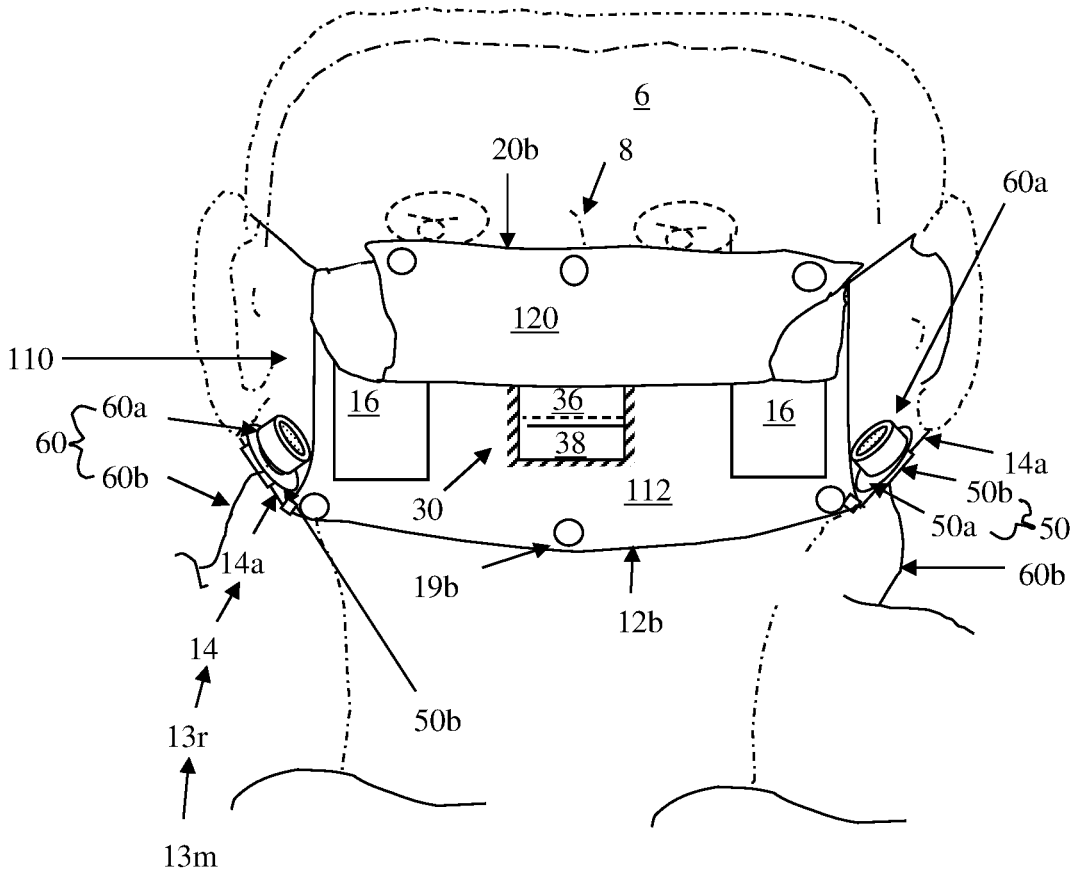
FIG. 43 shows the other version of the mask of FIG. 9 with the other version of the drape lifted.
Figure 44:
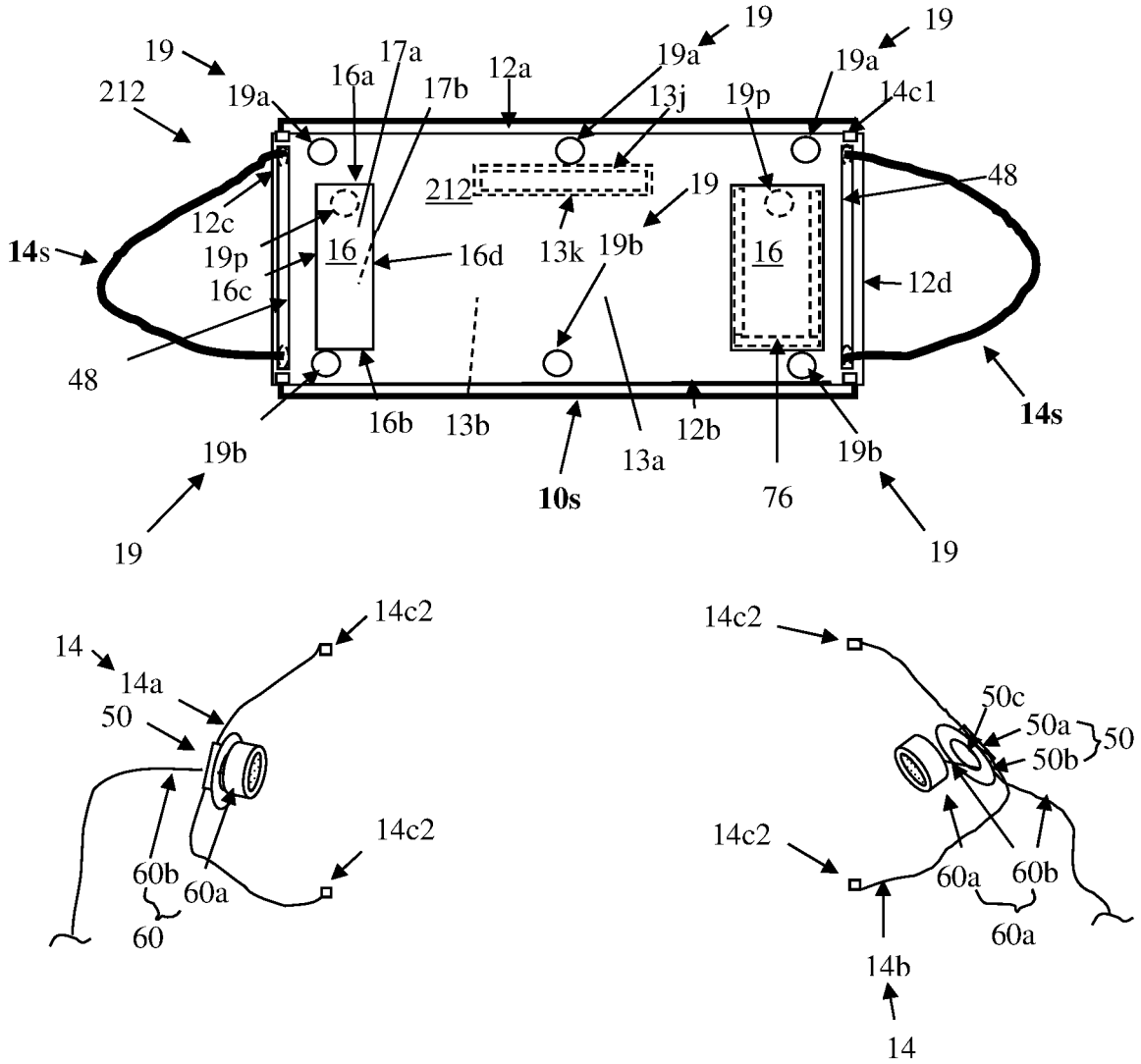
FIG. 44 illustrates a nose bar, pockets of varying sizes, with one pocket attached with two past fasteners.

Adaptations and modifications using current knowledge of mask, fasteners, and filtering materials are intended to be comprehended within the meaning and range of equivalents of the disclosed versions of the mask. The filter material 21*f* may be any filtering material available in the market and used for protective purposes in mask. A facial protective device such as the mask 10 may be comprise a base 12 with pockets 16, and one or more of the following: a base filter pocket 21*g* allowing filter material 21*f* specific to the tasks at hand to be inserted; an opening area 30 with an opening 30*a* sized for a device to be inserted in a wearer's mouth; one or more drapes 20 sized to drape over the base 12 covering the device inserted in the wearer's mouth; one or more drape cargo pockets 26; a drape filter pocket 26*h* for inserting more filter material 21*f*; a drape extension 40 sized to attach to the drape 20 and extend downward or fold up over the base 12 providing additional protection; a headset holder 50 disposed and sized to hold headsets such as ear buds 60 or blue tooth devices; and attachment slots 48, hear after called slots, that allow the base 12 to be attached to and be worn over other facial covering with the other facial covering's ear loops 14*s* or straps passed through the slots 48 holding the base 12 and the other facial covering 10*s* to the wearer's face 100, pockets 16 attached with detachable fasteners such as hook and loop fasteners 76 allowing the pockets to be removed, and a nose bar 13*j* shown in FIG. 44. For example, FIG. 43 shows the other mask 110 of FIG. 9 with the addition of headset holders 50. The other drape 120 has been lifted to better show the positioning of the pockets 16 and the opening area 30 relative to the wearer's nose 100. The pockets 16 spaced from the wearer's nose 8 and the opening area 30 below the nose 8 with the headset holders 50 on the ear loops 14 holding ear buds 60. FIG. 44 shows the yet other base 212 of FIG. 20 with pockets 16 varying sizes, the ear loops 14 that are detachable, one of the pockets 16 held on the yet other base 212 with hook and loop fastener 76 allowing the pockets 16 to be detached, and the nose bar 13*j* of FIG. 2 that may be attached to the yet other base 212 with an adhesive or there be a bar panel 13*k* covering the nose bar 13*j*, the bar panel 13*k* sewn to the yet other base 212. The means and materials for carrying out various disclosed functions may take a variety of alternative forms without departing from the invention. For example, referring to FIGS. 19-20 and 28-34, the means for holding 13*m* the mask on a wearer's face and the pockets 16 of FIG. 20, may also be detachable using suitable means of attachments that allows for detachment and reattachment such as the hook and loop fastener system 76 shown with dashed lines on one of the pockets 16. It should be remembered that the phraseology or terminology employed herein is for the purpose of description and not of limitation.

I claim:

1. A mask comprising: a base; the base adapted to be covering a nasal area and a mouth of a wearer; the base further comprising a base top edge, a base bottom edge, a base one side edge, a base other side edge, a base first surface, and a base second surface; the base further comprising a means for holding the mask in position on a wearer's face; and the base further comprising one or more pockets; and the one or more pockets adapted to be disposed spaced from a wearer's nose and mouth;

an opening area; the opening area adapted to be disposed over a wearer's mouth; and the opening area having an opening; and the opening sized for a device to be inserted through the opening into the wearer's mouth;

the opening area further comprises a primary cover and a secondary cover; the primary cover overlapping the secondary cover; the primary cover and the secondary cover disposed to cover the opening of the opening area; and the primary cover and the secondary cover disposed so as to allow the device to be inserted between the primary cover and the secondary cover into the wearer's mouth;

wherein the primary cover has a primary filter pocket and the secondary cover has a secondary filter pocket.

2. The mask of claim 1 further comprising a base filter pocket; and the base having a base first part and a base second part with the base filter pocket formed there between.

3. The mask of claim 1 further comprising one or more attachment slots; at least one of the one or more attachment slots disposed between one of the one or more pockets and the base one side edge; another one of the one or more attachment slots disposed between another one of the one or more pockets and the base other side edge; the base is disposed overlaying an other facial covering; the one or more attachment slots disposed and sized to receive ear loops of the other facial covering; and the means for holding the mask being detachable.

4. The mask of claim 3 further comprising one or more headset holders; the headset holders disposed on ear loops, the ear loops being the means for holding the mask; and the headset holders having an eyelet sized to receive an ear bud.

5. The mask of claim 1 wherein the base comprises first cords and second cords; the first cords disposed traverse to the second cords; and the first cords and the second cords forming a grid structure.

6. The mask of claim 1 further comprising one or more headset holders; the headset holders disposed on ear loops; the ear loops being the means for holding the mask; and the headset holders having an eyelet sized to receive an ear bud.

7. The mask of claim 1 further comprising a drape; and the drape disposed and sized to at least cover the base.

8. The mask of claim 7 wherein the drape having a drape one side edge extended and a drape other side edge extended; and the drape having a drape top edge disposed along the base top edge with the drape extending downward across the base and folded upward along the base bottom edge with a drape bottom edge disposed along the drape top edge.

9. The mask of claim 8 wherein the drape further comprises one or more drape cargo pockets.

10. The mask of claim 9 wherein the drape is removable; and the drape is secured to the base with fasteners.

11. The mask of claim 7 further comprising a drape extension having an extension first surface and an extension second surface, and one or more extension first surface top fasteners, the one or more extension first surface top fasteners disposed to attach to one or more drape second surface bottom fasteners on a drape second surface, providing additional protection for the device inserted through the opening area.

12. The mask of claim 7 further comprising a drape filter pocket; the drape comprises a drape first surface having a drape first surface top edge overlapped by a drape flap having a flap edge; and the drape filter pocket is disposed and sized to allow filter material to be inserted between the flap edge and the drape first surface into the drape filter pocket.

13. The mask of claim 7 further comprising one or more headset holders; and each of the headset holders disposed on an ear loop, the ear loops being the means for holding the mask; each of the headset holders having an eyelet sized to receive an ear bud.

* * * * *